US009551954B2

(12) United States Patent
Yamazaki

(10) Patent No.: US 9,551,954 B2
(45) Date of Patent: Jan. 24, 2017

(54) IMAGE FORMING APPARATUS

(71) Applicant: CANON KABUSHIKI KAISHA, Tokyo (JP)

(72) Inventor: Katsuyuki Yamazaki, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/859,593

(22) Filed: Apr. 9, 2013

(65) Prior Publication Data

US 2013/0286132 A1 Oct. 31, 2013

(30) Foreign Application Priority Data

Apr. 26, 2012 (JP) ..... 2012-101478

(51) Int. Cl.
*G03G 15/043* (2006.01)
*G03G 15/00* (2006.01)

(52) U.S. Cl.
CPC ..... *G03G 15/043* (2013.01); *G03G 15/5062* (2013.01)

(58) Field of Classification Search
CPC ..... G03G 15/043; G03G 15/5062; G03G 15/5052; B41J 2/435; B41J 2/385; G02B 26/12
USPC ..... 347/118, 235, 247
See application file for complete search history.

(56) References Cited

U.S. PATENT DOCUMENTS 4,794,413 A 12/1988 Yamazaki et al. ..... 346/160
6,377,381 B1 4/2002 Matsuo ..... 359/204.1
7,450,145 B2 11/2008 Yamazaki ..... 347/261
2003/0156184 A1 8/2003 Suzuki et al. ..... 347/249
2008/0013972 A1 1/2008 Matsuda ..... 399/45
2008/0225905 A1 9/2008 Inagawa et al. ..... 372/24
2011/0149009 A1* 6/2011 Iriyama et al. ..... 347/247
2011/0205324 A1 8/2011 Shukuya ..... 347/116

FOREIGN PATENT DOCUMENTS

JP 2001-013434 1/2001
JP 2003-185953 7/2003
(Continued)

OTHER PUBLICATIONS

European Search Report dated Sep. 25, 2013 in counterpart European Patent Application No. 13164240.7.
(Continued)

*Primary Examiner* — Sarah Al Hashimi
(74) *Attorney, Agent, or Firm* — Fitzpatrick Cella Harper & Scinto

(57) ABSTRACT

An image forming apparatus is provided that can adjust an inclination deviation even after a laser scanner unit and a photosensitive drum are embedded. A CPU 601 selects at least two screen angles from among screen angles, and generates image signals corresponding to the respective selected at least two screen angles, based on these angles. The CPU 601 causes light emitting elements to emit light beams at different emission timings with reference to a timing on which a BD 803 detects the light beam, based on a generated image signal, thereby forming latent images of test images on a photosensitive drum. The latent images formed on the photosensitive drum are developed, and test images are formed on a recording medium.

10 Claims, 22 Drawing Sheets

(56) References Cited

FOREIGN PATENT DOCUMENTS

| | | |
|---|---|---|
| JP | 2003-266761 | 9/2003 |
| JP | 2005-053000 | 3/2005 |
| JP | 2006-305879 | 11/2006 |
| JP | 2007-055089 | 3/2007 |
| JP | 2008-221847 | 9/2008 |
| JP | 2011-145639 | 7/2011 |

OTHER PUBLICATIONS

U.S. Appl. No. 13/860,366, filed Apr. 10, 2013; Inventor: Katsuyuki Yamazaki.

"Moire Pattern", Mar. 27, 2012, XP002718036, Retrieved from the Internet: URL: http://en.wikipedia.org/w/index.php?title=Moir%C3%A9_pattern$oldid=484133344 [retrieved on Dec. 16, 2013].

Extended European Search Report, which is dated Jan. 14, 2014 in counterpart European Patent Application No. 13164240.7.

* cited by examiner

FIG. 5

| ADDRESS | DATA | CONTENT |
|---|---|---|
| 0 | -3 | FACTORY-MEASURED VALUE OF LASER A SECTION 1 |
| 1 | -2 | FACTORY-MEASURED VALUE OF LASER A SECTION 2 |
| 2 | -2 | FACTORY-MEASURED VALUE OF LASER A SECTION 3 |
| 3 | -1 | FACTORY-MEASURED VALUE OF LASER A SECTION 4 |
| 4 | -1 | FACTORY-MEASURED VALUE OF LASER A SECTION 5 |
| 5 | 0 | FACTORY-MEASURED VALUE OF LASER A SECTION 6 |
| 6 | 1 | FACTORY-MEASURED VALUE OF LASER A SECTION 7 |
| 7 | 2 | FACTORY-MEASURED VALUE OF LASER A SECTION 8 |
| 8 | 2 | FACTORY-MEASURED VALUE OF LASER A SECTION 9 |
| 9 | 3 | FACTORY-MEASURED VALUE OF LASER A SECTION 10 |
| 10 | 97 | FACTORY-MEASURED VALUE OF LASER B SECTION 1 |
| 11 | 98 | FACTORY-MEASURED VALUE OF LASER B SECTION 2 |
| ... | ... | ... |
| 15 | 100 | FACTORY-MEASURED VALUE OF LASER B SECTION 5 |
| ... | ... | ... |
| 20 | 197 | FACTORY-MEASURED VALUE OF LASER C SECTION 1 |
| ... | ... | ... |
| 35 | 200 | FACTORY-MEASURED VALUE OF LASER C SECTION 5 |
| ... | ... | ... |
| ... | ... | ... |
| ... | ... | ... |
| 70 | 795 | FACTORY-MEASURED VALUE OF LASER H SECTION 1 |
| ... | ... | ... |
| 75 | 801 | FACTORY-MEASURED VALUE OF LASER H SECTION 5 |
| ... | ... | ... |
| 78 | 803 | FACTORY-MEASURED VALUE OF LASER H SECTION 9 |
| 79 | 804 | FACTORY-MEASURED VALUE OF LASER H SECTION 10 |
| 80 | 0 | PATTERN SELECTION ROW: LEFT |
| 81 | 0 | PATTERN SELECTION ROW: MIDDLE |
| 82 | 0 | PATTERN SELECTION ROW: RIGHT |
| 83 | 0 | (RESERVED) |

FIG. 13

| RC ARRAY | (0, 0, 0) | (-1, 1, 1) | CONTENT |
|---|---|---|---|
| 0 | -3 | -5 | LASER A SECTION 1 |
| 1 | -2 | -3 | LASER A SECTION 2 |
| 2 | -2 | -3 | LASER A SECTION 3 |
| 3 | -1 | -1 | LASER A SECTION 4 |
| 4 | -1 | -1 | LASER A SECTION 5 |
| 5 | 0 | 1 | LASER A SECTION 6 |
| 6 | 1 | 2 | LASER A SECTION 7 |
| 7 | 2 | 4 | LASER A SECTION 8 |
| 8 | 2 | 4 | LASER A SECTION 9 |
| 9 | 3 | 5 | LASER A SECTION 10 |
| 10 | 97 | 96 | LASER B SECTION 1 |
| 11 | 98 | 97 | LASER B SECTION 2 |
| ... | ... | ... | ... |
| 15 | 100 | 101 | LASER B SECTION 5 |
| ... | ... | ... | ... |
| 20 | 197 | 196 | LASER C SECTION 1 |
| ... | ... | ... | ... |
| 35 | 200 | 201 | LASER C SECTION 5 |
| ... | ... | ... | ... |
| ... | ... | ... | ... |
| ... | ... | ... | ... |
| 70 | 795 | 794 | LASER H SECTION 1 |
| ... | ... | ... | ... |
| 75 | 801 | 802 | LASER H SECTION 5 |
| ... | ... | ... | ... |
| 78 | 803 | 805 | LASER H SECTION 9 |
| 79 | 804 | 806 | LASER H SECTION 10 |
| | 0 | -1 | PATTERN SELECTION ROW: LEFT |
| | 0 | 1 | PATTERN SELECTION ROW: MIDDLE |
| | 0 | 2 | PATTERN SELECTION ROW: RIGHT |

IMAGE FORMING APPARATUS

BACKGROUND OF THE INVENTION

Field of the Invention

The present invention relates to image forming apparatuses, such as a copier, a laser beam printer and a facsimile, and particularly to image forming apparatuses that form an image using a plurality of laser beams.

Description of the Related Art

To realize high speed image forming and high image quality, image forming apparatuses that include a multi-laser light source provided with a plurality of light emitting elements emitting laser beams have been increasing in the market. The image forming apparatus using the multi-laser light source can form an image at high speed, and output an image with high quality.

Some multi-laser light sources include a plurality of light emitting elements arranged in series at prescribed intervals. The light emitting elements are disposed such that different positions on a photosensitive member in the rotational direction of the photosensitive member are exposed to laser beams emitted from the respective light emitting elements. In a recent image forming apparatus, to form an image with a high resolution, the multi-laser light source is rotationally adjusted when the apparatus is assembled. This adjustment allows exposure position intervals (exposure spot intervals) of laser light in the rotational direction of the photosensitive member to be in conformity with the resolution of the image forming apparatus.

Japanese Patent Application Laid-Open No. 2001-13434 discloses that positional deviations of exposure spots created by laser beams in the main scanning direction in which the laser beams scan a photosensitive member are corrected by adjusting light emission timing of each laser. The light emission timing is adjusted depending on an optical property of scanning light from a laser scanner unit (optical scanning unit; hereinafter, called "LSU") that includes a multi-laser light source provided with a plurality of light emitting elements. The deviations of pixels due to positional deviations of exposure spots of respective laser beams in the main scanning direction are corrected. This correction can suppress the relative deviation of pixels formed by the respective laser beams in the sub-scanning direction, which is the rotational direction of the photosensitive member. Expensive dedicated components, such as a sensor capable of responding at high speed and a focusing lens, are required to realize the invention of Japanese Patent Application Laid-Open No. 2001-13434. Accordingly, adoption of such a configuration in every image forming apparatus causes a problem of cost. Thus, in a conventional art, when an LSU is manufactured, the optical property of scanning light is measured using a measurement jig simulating an ideal position of the photosensitive drum, and an adjustment value for light emission timing of each laser, which is derived from the measurement result, is recorded in a ROM. In an actual use, the image forming apparatus reads the adjustment value from the ROM, adjusts the light emission timing, and forms an image.

Each of the LSU and the photosensitive drum is installed at prescribed positions in the image forming apparatus. In the case of adjusting the positional deviations of exposure spots based on the laser emission timings of the respective lasers as with Japanese Patent Application Laid-Open No. 2001-13434, the LSU embedded in the image forming apparatus cannot be adjusted correctly unless the relative positions of the embedded LSU and the photosensitive drum are ideal. In the case where the light emission timings cannot be adjusted correctly, an exposure spot row is inclined from the sub-scanning direction at a prescribed angle; this inclination is called inclination deviation. In a recent multi-laser that has a number of lasers, the distance between the opposite ends of plurally arranged lasers is large. Accordingly, adverse effects of the inclination deviation are large. For correct adjustment of laser light emission timing, an electric adjustment method is inexpensive. However, in this method, writing adjustment factors and magnification adjustment factors coexist as much as the number of lasers. Accordingly, adjustment cannot easily be performed.

In view of these conventional problems, it is a main object of the present invention to provide an image forming apparatus that can adjust an inclination deviation even after an LSU and a photosensitive member are embedded.

SUMMARY OF THE INVENTION

An image forming apparatus achieving the above object includes: a rotating photosensitive body; a generating unit; a light source; a deflection unit; a detecting unit; a control unit; and an image forming unit. The generating unit can set screen angles, and generates image signals based on the set screen angles. The light source includes light emitting elements that emit light beams to which the photosensitive body is exposed based on the image signals generated by the generating unit. The light source is arranged such that different positions on the photosensitive body in the rotational direction of the photosensitive body are exposed to the light beams emitted from the respective light emitting elements. The deflection unit deflects the light beams emitted from the light source so as to scan the photosensitive body. The detecting unit detects the light beams deflected by the deflection unit. The control unit controls the light source such that the detecting unit can change emission timings with reference to the timing on which the light beam is detected, thereby causing the light emitting elements to emit the light beams based on the image signals. The image forming unit develops, with toner, latent images formed on the photosensitive body by exposure to the light beams, thereby forming an image on a recording medium. In such an image forming apparatus, the generating unit selects at least two screen angles from among the screen angles, and generates the image signals corresponding to the respective selected at least two screen angles, based on these selected angles. The control unit causes the light emitting elements to emit the light beams on different emission timings with reference to a timing on which the detecting unit detects the light beam, based on the generated image signal, thereby forming the latent images of test images on the photosensitive body. The image forming unit forms test images on the recording medium from the latent images formed on the photosensitive body.

Further features of the present invention will become apparent from the following description of exemplary embodiments with reference to the attached drawings.

BRIEF DESCRIPTION OF THE DRAWINGS

FIG. 5 is a diagram illustrating initial adjustment values.

FIG. 13 is a diagram exemplifying adjustment values of an array RC.

DESCRIPTION OF THE EMBODIMENTS

Preferred embodiments of the present invention will now be described in detail in accordance with the accompanying drawings.

First Embodiment

Configuration of Image Forming Apparatus

Figure 1:
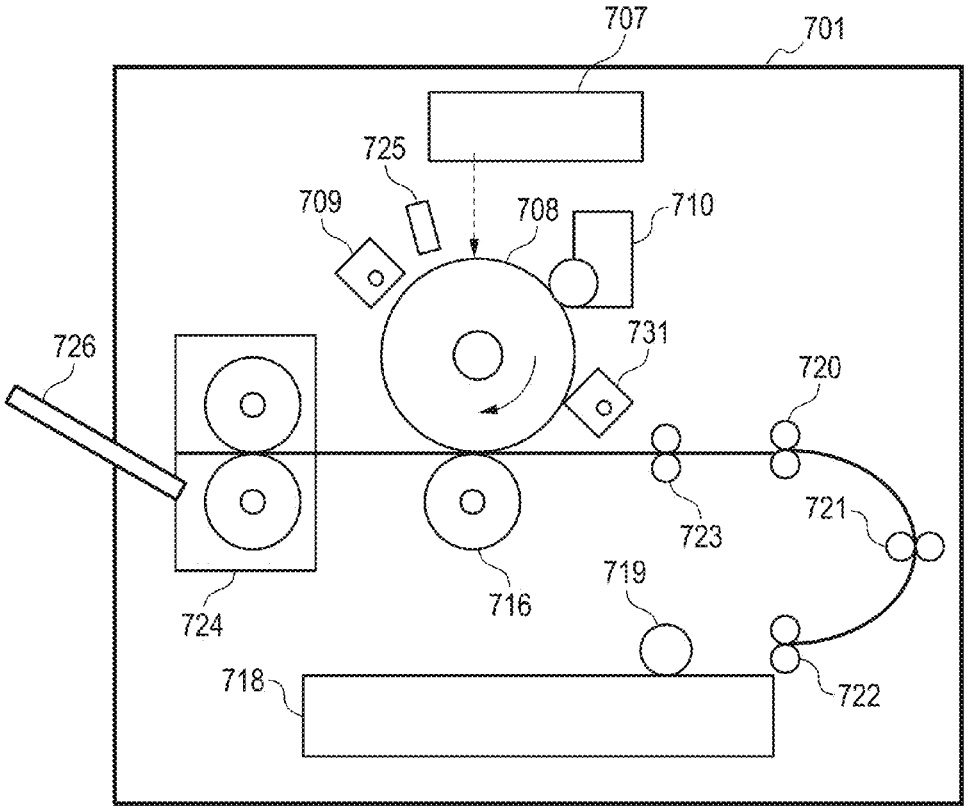
FIG. 1 is a diagram of an overall configuration of an image forming apparatus of a first embodiment.

FIG. 1 is a diagram of an overall configuration of an image forming apparatus 701 of a first embodiment of the present invention. The image forming apparatus 701 internally includes a controller (not illustrated) where an after-mentioned CPU is arranged at the center. The image forming apparatus 701 is integrally controlled by the controller to form an image. The image forming apparatus 701 includes a touch panel operation unit (not illustrated), which allows various instructions and data required for forming an image to be input on the operation unit. An image data is input into the image forming apparatus 701 through a PC (personal computer) and a network.

The image forming apparatus 701 includes a charging unit 725 that charges the surface of a photosensitive drum 708, which is a photosensitive member. The image forming apparatus 701 includes a laser scanner unit 707 (hereinafter, called LSU 707) including a multi-laser light source. The LSU 707 emits laser light (light beams) according to an image signal (to be described later) generated based on the input image data. The photosensitive drum 708, whose surface is charged by the charging unit 725, is exposed to laser light emitted from the LSU 707. An electrostatic latent image is formed on a part of the photosensitive drum 708 having been exposed to the laser light. The electrostatic latent image is developed with toner by a toner developing unit 710 to form a toner image on the photosensitive drum 708.

A sheet cassette 718 stores recording media, such as printer sheets. A recording medium stored in the sheet cassette 718 is conveyed by sheet conveying rollers 719 to 723 to a transfer nip (transfer unit) formed between a transfer roller 716, which is a transfer device, and the photosensitive drum 708. The transfer roller 716 transfers the toner image on the photosensitive drum 708 onto the recording medium. The recording medium, on which the toner image has been transferred, is conveyed to a fixing unit 724. At the fixing unit 724, the toner image on the recording medium is subjected to a fixing process. The recording medium, on which the toner image has been fixed by the fixing unit 724, is ejected to an ejection tray 726. Toner that has not been transferred onto the recording medium and remains on the photosensitive drum 708 is collected by a drum cleaner 709. The embodiment is not limited to the image forming apparatus forming a monochrome image that is illustrated in FIG. 1. Instead, the embodiment may be a color image forming apparatus. For instance, the embodiment may be an image forming apparatus that includes photosensitive drums respectively supporting yellow, magenta, cyan and black, and a light source for exposing each photosensitive drum to light.

Figure 2A:
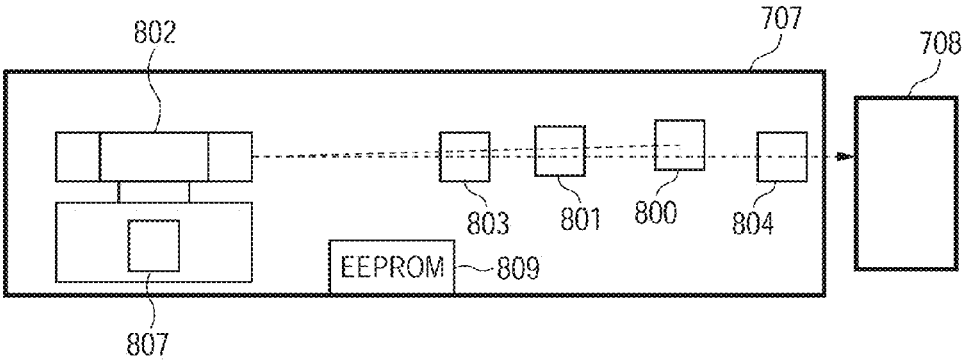
FIG. 2A is a diagram illustrating an optical path along which a LSU performs exposure on a photosensitive drum.
Figure 2B:
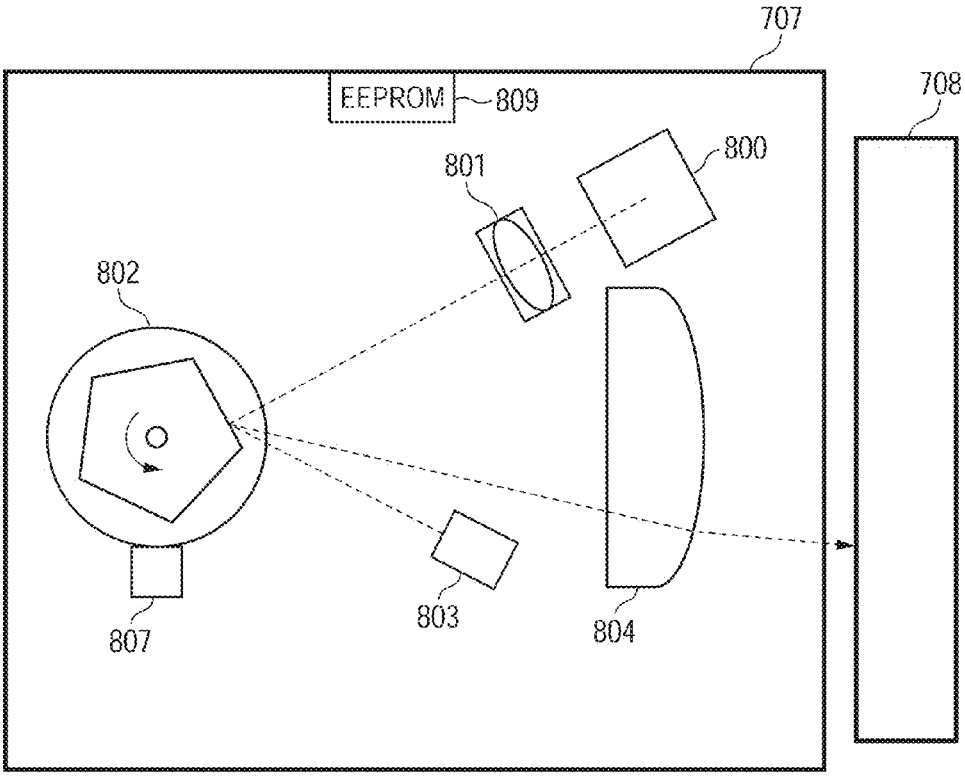
FIG. 2B is a diagram illustrating the optical path along which the LSU performs exposure on the photosensitive drum.

FIGS. 2A and 2B are diagrams illustrating the optical path of laser light to which the LSU 707 exposes the photosensitive drum 708. FIG. 2A is a side view of the LSU 707. FIG. 2B is a plan view of the LSU 707. The LSU 707 causes a light emitter 800 (light source) to emit laser light. In this embodiment, the light emitter 800 is a monolithic multi laser in which a plurality of light emitting elements (a plurality of light emitting portions) is linearly arranged. The light emitter 800 of this embodiment includes eight light emitting elements. Although not illustrated, the eight light emitting elements are disposed so that different positions on the photosensitive drum 708 in the rotational direction (sub-scanning direction) of this photosensitive drum 708 can be exposed to laser light emitted from the respective light emitting elements. Furthermore, the eight light emitting elements are disposed so that different positions on the photosensitive drum 708 in the axial direction of this photosensitive drum 708 (main scanning direction) are exposed to the laser light emitted from the respective light emitting elements. The LSU 707 includes a polygon mirror 802, which is a deflection unit. The polygon mirror 802 is rotatably driven by a DC brushless motor. The rotation of a magnetic pole of the DC brushless motor is detected by an FG sensor 807 including a Hall element. The laser light emitted from the light emitter 800 passes through collimating lens 801 to become parallel light, and is deflected by the rotating polygon mirror 802. The laser light deflected by the polygon mirror 802 serves as scanning light that scans the photosensitive drum 708. As illustrated in FIG. 2B, the LSU 707 includes a beam detector 803 (hereinafter, called a BD 803) as a detecting unit on which the laser light deflected by the polygon mirror 802 is incident. The BD 803 outputs a synchronization signal in response to reception of the laser light. The emission timing of the laser light emitted from each light emitting element is controlled by an after-mentioned CPU based on the synchronization signal. The LSU 707 includes an fθ lens 804 for scanning the laser light guided to the photosensitive drum 708, on this photosensitive drum 708 at a uniform velocity. The laser light deflected by the polygon mirror 802 passes through the fθ lens 804 and is imaged on the photosensitive drum 708. An EEPROM 809 is stored with initial adjustment values for controlling the laser light emission timing (laser light emission timing) from each of the light emitting elements. The initial adjustment values are adjustment values measured when the LSU 707 is manufactured, in a state where the relative positional relationship with the photosensitive drum 708 is ideal.

Figure 3:
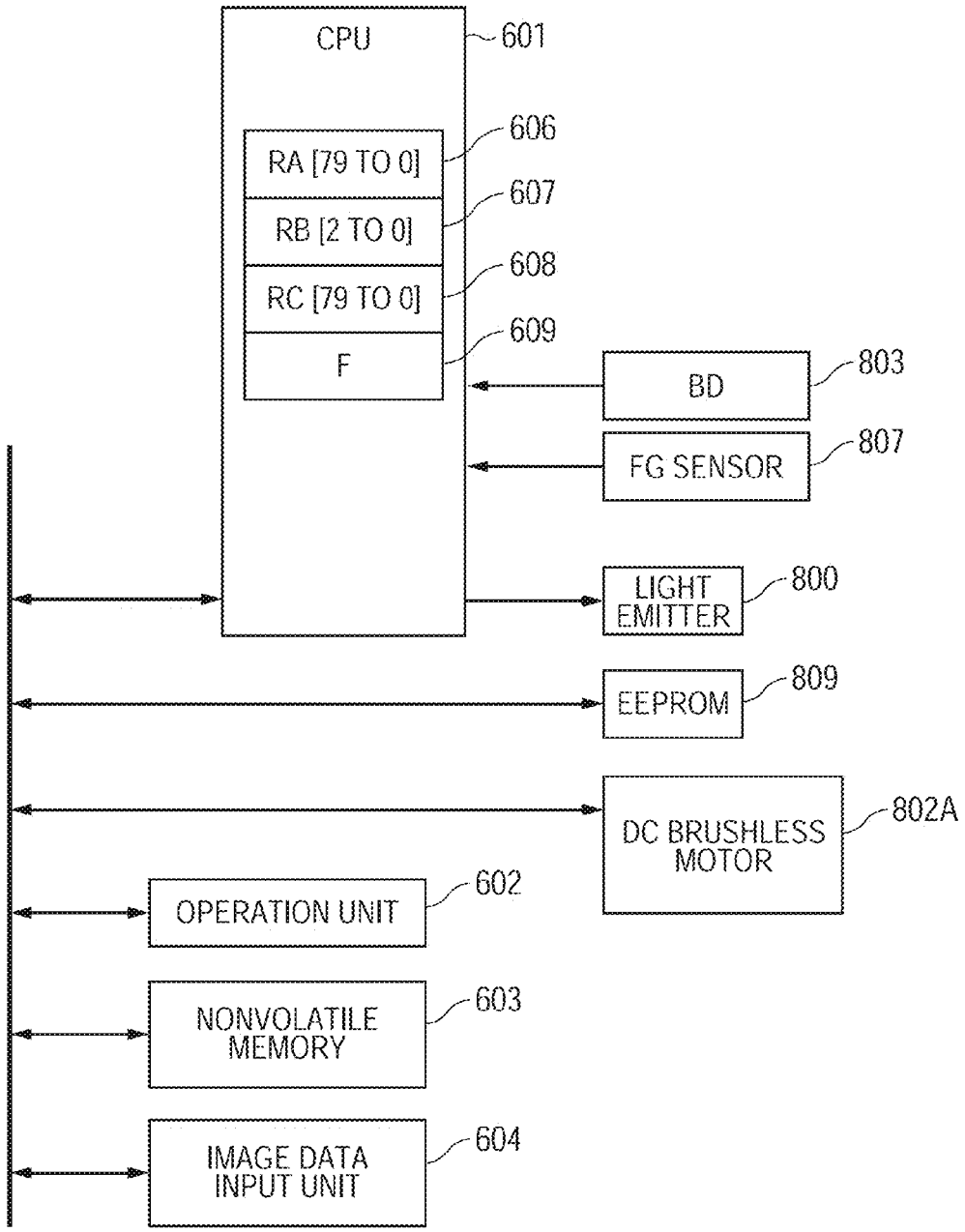
FIG. 3 is a diagram of a configuration of a controller.

FIG. 3 is a diagram of the configuration of the controller internally included in the image forming apparatus 701. The controller has a configuration where a CPU 601 is arranged at the center. An operation unit 602, a nonvolatile memory 603, an image data input unit 604, a DC brushless motor 802A driving the polygon mirror 802, the EEPROM 809 embedded in the LSU 707 are connected to the CPU 601 via a bidirectional communication bus. The BD 803 and the FG sensor 807 are directly connected to internal ports of the CPU 601. The CPU 601 can set the number of screen lines and a screen angle for an image, according to the type of the image. The types include a character image and a picture image, such as a photograph. That is, the EEPROM 809 is stored with plural data of the number of screen lines and the screen angles in conformity with respective types of images. The CPU 601 determines the image type based on the input image data input on the image data input unit, and sets the number of screen lines and the screen angle based on the image type. The input image data is processed so as to form an image at the set number of screen lines and screen angle, thereby generating an image signal subjected to PWM for driving the light emitter 800.

The CPU 601 is also connected to the light emitter 800, and drives the lasers of the light emitter 800, according to the PWM image signal and an analog laser intensity adjusting signal, with reference to the synchronization signal. Accordingly, the light emitter 800 can form an image on the photosensitive drum 708, according to the input image data, at a light intensity according to the light intensity adjusting signal. The CPU 601 is a control unit capable of changing the timing on which the light emitter 800 emits laser light with reference to the synchronization signal, for each light emitting element. An internal register of the CPU 601 includes an array RA 606 capable of storing 80 data, and an array RB 607 capable of storing three data, an array RC 608 capable of storing 80 data, and a register F 609 capable of storing one data.

The initial adjustment values stored in the EEPROM 809 are read by the CPU 601 from the EEPROM 809 and held in the nonvolatile memory 603, when the LSU 707 is embedded in the image forming apparatus 701. The nonvolatile memory 603 can be stored with not only the initial adjustment values but also correction values input through an operation by a user on the operation unit 602. The correction values are for correcting the initial adjustment values derived in the ideal conditions when the LSU 707 is manufactured. The initial adjustment values are corrected using the correction values, thereby correcting deviations from the ideal conditions after the LSU 707 and the photosensitive drum 708 are embedded in the image forming apparatus 701.

The CPU 601 reads the initial adjustment values and the correction values from the nonvolatile memory 603 into the internal register, and uses the values in image formation. The CPU 601 has a configuration allowing easier access to nonvolatile memory 603 than to the EEPROM 809. Accordingly, the performance of software and hardware can be improved by copying the initial adjustment values from the EEPROM 809 to the nonvolatile memory 603.

Figure 4:
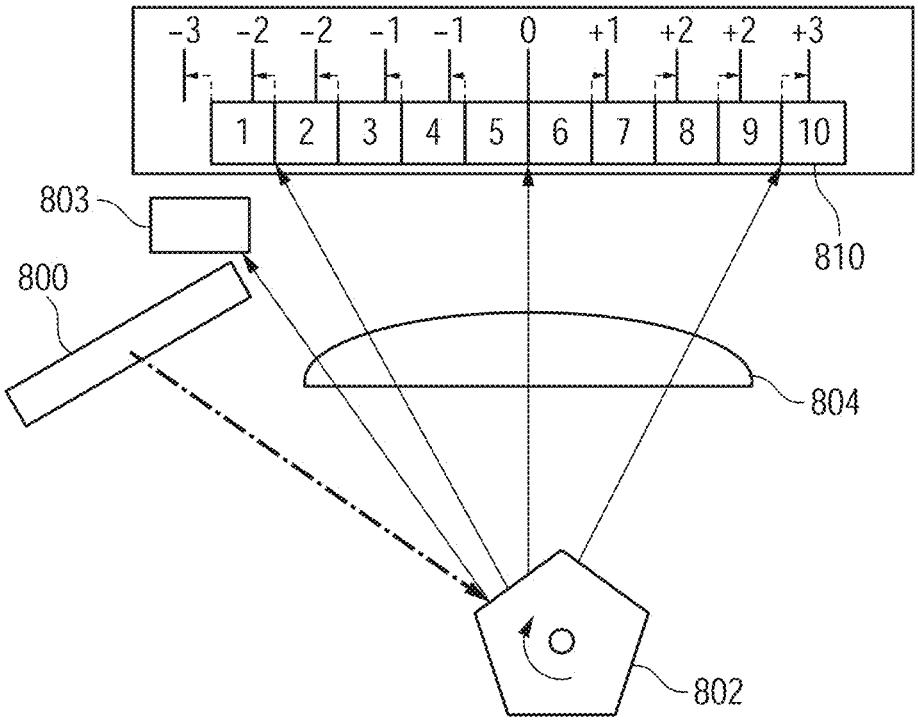
FIG. 4 is a diagram illustrating adjustment of light emission timing of each laser of a light emitter.

FIG. 4 is a diagram illustrating adjustment of light emission timing of each laser of the light emitter 800. An image region in which a toner image is formed on the photosensitive drum 708 has, for instance, dimensions of 13 inches (ca. 330 [mm]) at the maximum. For instance, in the case where the resolution of the image forming apparatus is 1200 dpi, the number of pixels in the main scanning direction is about 15600. The light emitting elements are disposed so that different positions on the photosensitive drum 708 different from each other in the main scanning direction are exposed to the laser light emitted from the respective light emitting elements. Accordingly, different light emission timings are set for the respective light emitting elements with reference to the synchronization signal output from the BD 803. The image forming apparatus of this embodiment executes control of the laser light emission timing of each light emitting element on each of ten image sections 810 from "1" to "10", with reference to the synchronization signal; one of ten sections divided from one scanning line includes 1560 pixels. Thus, ten initial adjustment values are prepared in conformity with the image sections 810 for each light emitting element. The light emitter 800 of this embodiment includes eight light emitting elements. Accordingly, 80 initial adjustment values are prepared.

The initial adjustment value is represented by a signed 16-bit data. Relative light emission timing differences from the light emission timing of the leading light emitting element, where an image height indicating the position in the main scanning direction is "0", are recorded in a unit of 1/16 pixel at 1200 dpi. For instance, in the case where the initial adjustment value is "160", the light emission timing is adjusted based on a delay time (ca. 2 microseconds) equivalent to 10 pixels (ca. 210 [μm]). The correction value is also represented as with the initial adjustment value, and used for adjustment.

FIG. 5 is a diagram illustrating initial adjustment values copied from the EEPROM 809 to the nonvolatile memory 603. Addresses "0" to "83" are provided in a recording region of the nonvolatile memory 603. The initial adjustment values (data) are stored in the addresses "0" to "79" in a sequence of eight light emitting elements A to H. For instance, data for adjusting the light emission timing of the light emitting element A according to the position of the image sections 810 are stored in the addresses "0" to "9". For instance, the light emission timing of the light emitting element A is adjusted according to the data "−3" in the address "0", thereby scanning the section "1" among the image sections 810. Subsequently, the light emitting element A, whose light emission timing is sequentially adjusted according to the data in the addresses "1" to "9", scans the sections "2" to "10" among the image sections 810. Likewise, the light emission timings of the light emitting elements B to H are adjusted according to the data, thereby scanning the sections "1" to "10" among the image sections 810. The contents on and after the address "80" in the nonvolatile memory 603 will be described later.

Figure 6A:
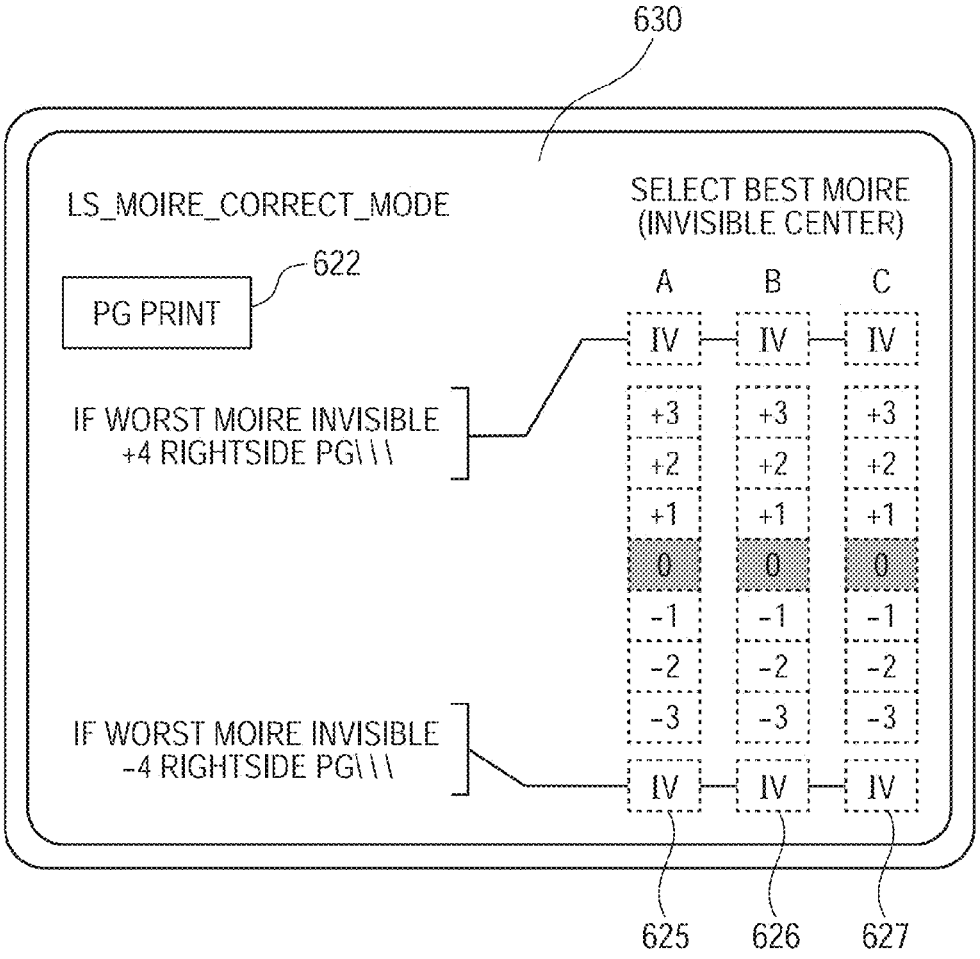
FIG. 6A is a diagram exemplifying an input screen displayed on an operation unit.
Figure 6B:
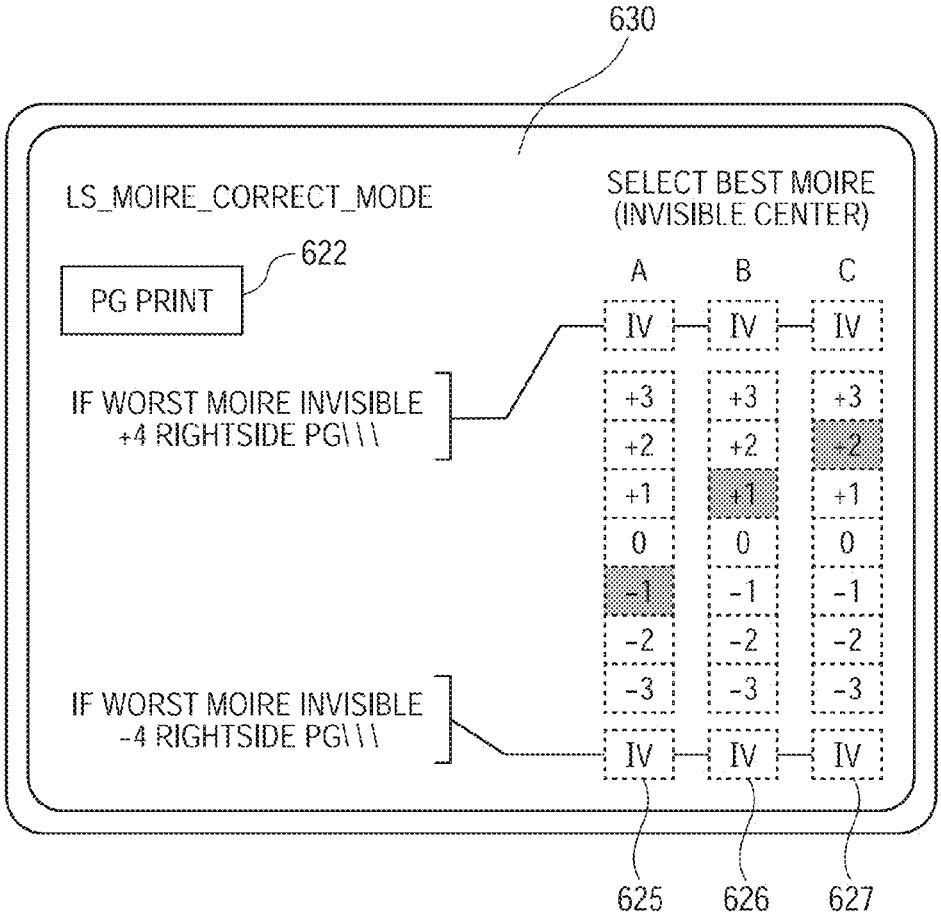
FIG. 6B is a diagram exemplifying an input screen displayed on the operation unit.
Figure 6C:
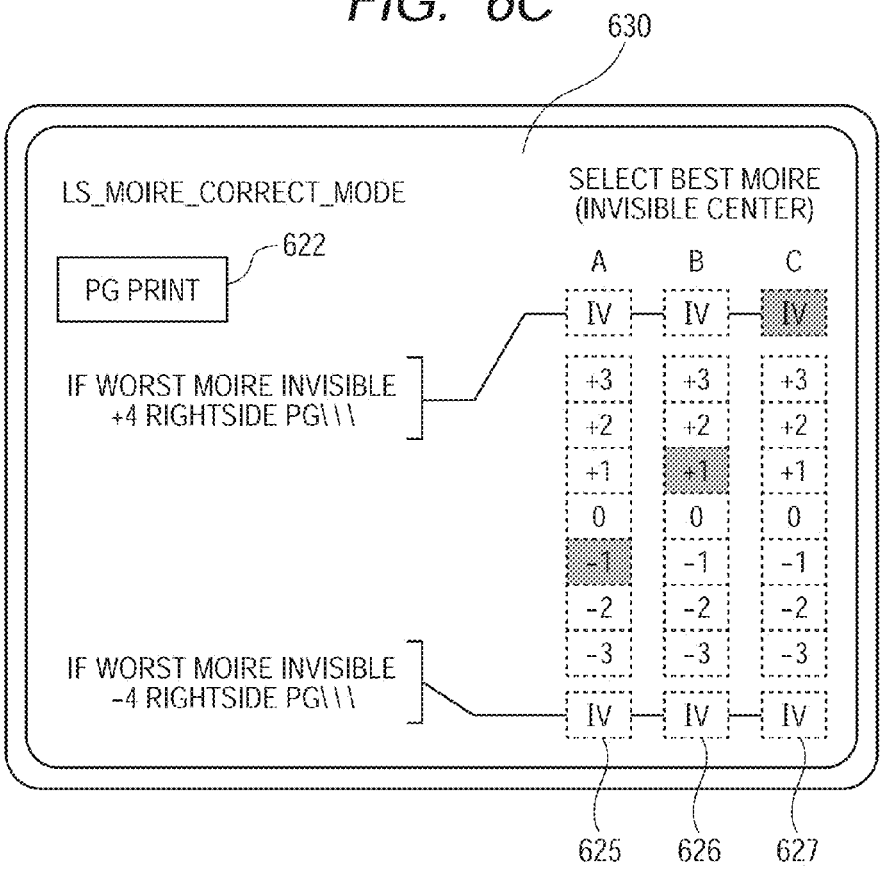
FIG. 6C is a diagram exemplifying an input screen displayed on the operation unit.

FIGS. 6A to 6C are diagrams exemplifying input screens 630 displayed on the operation unit 602 for allowing a user to input adjustment amounts. The input screen 630 is displayed by selecting a mode for inputting a correction value from among alternatives of operation modes included in a display menu displayed when the image forming apparatus 701 is turned on. The input screen 630 includes a push-type test print execution button 622, and input button columns 625, 626 and 627 for inputting adjustment amounts. In this diagram, buttons with solid-white characters in the input button columns 625, 626 and 627 represent a selected state, and buttons with broken lines represent a non-selected state. In the initial state, as illustrated in FIG. 6A, "0" is selected in each of the three input button columns 625, 626 and 627. In FIG. 6B, "−1" is selected in the input button column 625, "+1" is selected in the input button column 626, and "+2" is selected in the input button column 627. In FIG. 6C, "−1" is selected in the input button column 625, "+1" is selected in the input button column 626, and "+4" is selected in the input button column 627. The input button column 625 is for a correction value for the section "2" among image sections 810 in FIG. 4. The input button column 626 is for a correction value for the section "6" among the image sections 810 in FIG. 4. The input button column 627 is for a correction value for the section "9" among the image sections 810 in FIG. 4. Correction values for the sections "1", "3" to "5", "7", "8" and "10" among the image sections 810 in FIG. 4 are derived according to the initial adjustment values and the input correction values for the sections "2", "6" and 9" among the image sections 810.

Arrangement of Exposure Spots

Figure 7A:
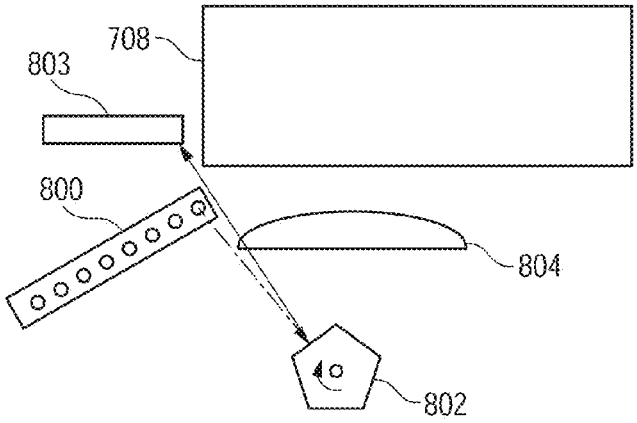
FIG. 7A is a diagram illustrating exposure spots on the photosensitive drum.

FIGS. 7A to 7E are diagrams illustrating exposure spots on the photosensitive drum 708 exposed by the LSU 707. FIG. 7A illustrates the optical path along which laser light emitted from the leading light emitting element of the light emitter 800 of the LSU 707 is reflected by the polygon mirror 802 and enters the BD 803. The laser light moves from the left to the right in the diagram on the fθ lens 804 owing to rotation of the polygon mirror 802 at a constant angular velocity. The laser light passing through the fθ lens 804 scans the photosensitive drum 708 at a substantially constant scanning velocity. In the image forming apparatus of this embodiment, the laser light passing through the fθ lens enters the BD 803. In a strict sense, a constant angular velocity component remains. In FIGS. 7A to 7E, the refraction by the fθ lens 804 is omitted for emphasizing the component. A time interval of the synchronization signal output from the BD 803 is one scanning time, which is for instance one millisecond.

Figure 7B:
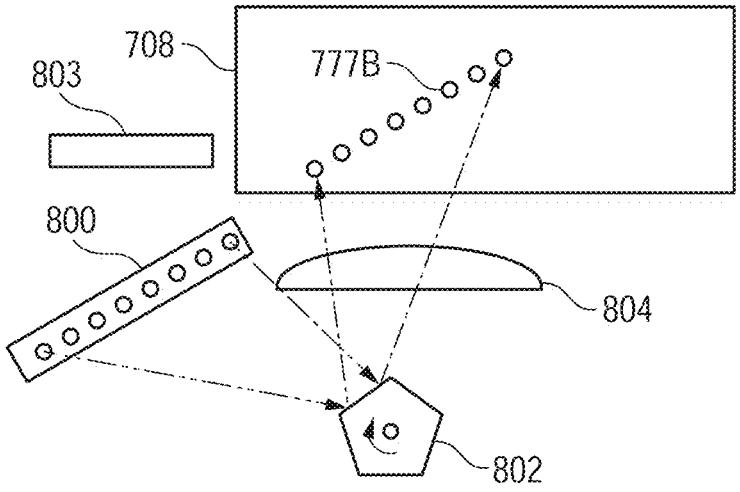
FIG. 7B is a diagram illustrating exposure spots on the photosensitive drum.
Figure 7C:
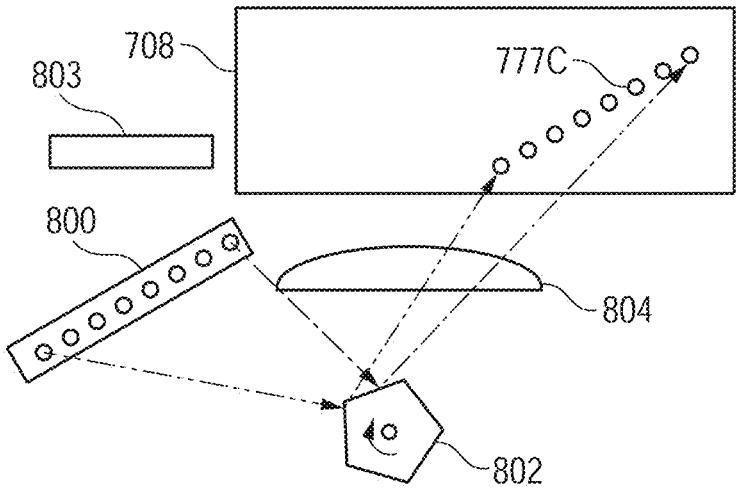
FIG. 7C is a diagram illustrating exposure spots on the photosensitive drum.

FIG. 7B illustrates the optical path along which the entire laser light emitted from the light emitter 800 is reflected by the polygon mirror 802 and enters the photosensitive drum 708 after 100 microseconds has elapsed from the state of FIG. 7A. An exposure spot row 777B represents exposure spots on the photosensitive drum 708 due to the respective laser beams. FIG. 7C illustrates the optical path along which the entire laser light emitted from the light emitter 800 is reflected by the polygon mirror 802 and enters the photosensitive drum 708 after 7 microseconds has elapsed from the state of FIG. 7B. An exposure spot row 777C represents exposure spots on the photosensitive drum 708 due to the respective laser beams.

Figure 7D:
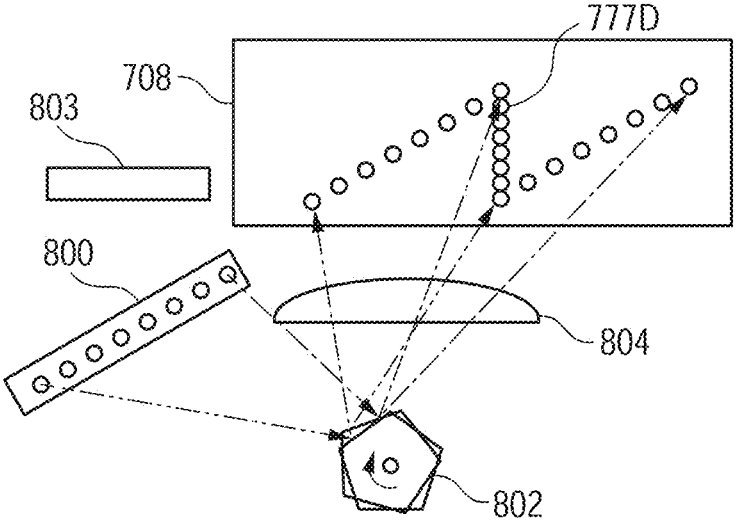
FIG. 7D is a diagram illustrating exposure spots on the photosensitive drum.

FIG. 7D is a diagram illustrating a pixel row 777D in the sub-scanning direction that is formed at a position indicated by an arrow in the main scanning direction in a time period from FIG. 7B to FIG. 7C. To expose the position indicated by the arrow in the main scanning direction, the light emitting element forming the final exposure spot in the main scanning direction among the exposure spots emits light, 7 microseconds after the light emitting element forming the leading exposure spots in the main scanning direction among the exposure spots emits light. Delay times of 6, 5, 4, 3, 2 and 1 microseconds in light emitting timing between the light emitting element forming the final exposure spot in the main scanning direction and the light emitting element forming the leading exposure spot in the main scanning direction are provided to align the pixel row 777D in parallel to the sub-scanning direction. In this ideal configuration, the pixel row 777D is aligned in parallel to the sub-scanning direction. To achieve such a pixel row 777D, the light emission timing of each light emitting element is adjusted.

The light emitting elements of the light emitter 800 vary in optical path difference, wavelength difference, difference in incident angle onto each lens. The light emission timing is adjusted for each scanning position (image sections 810) with reference to the detection timing of laser light by the BD 803 as the reference timing, and the each light emitting element emits light. Thus, the positional deviations of the exposure spots due to the variation can be prevented. A delay adjustment factor of the multi-laser at the central position image height 0 [mm] of the fθ lens 804 is called the amount of adjustment for main scanning writing. A delay adjustment factor at another image height is called the amount of adjustment for partial magnification.

A pixel row aligned with the sub-scanning direction, such as the pixel row 777D, can be realized by adjusting the relative light emission timings of the respective light emitting elements. For instance, the polygon mirror 802 and the fθ lens 804 cause the optical path of the laser light to deviate from the ideal condition. The deviation is compensated by adjusting the emission timing. Conventionally, the adjustment amount for the light emission timing of each light emitting element is according to the initial adjustment value stored in the EEPROM 809. In the image forming apparatus 701, the initial adjustment values are read from the EEPROM 809. The light emission timings are adjusted with reference to the detection timing of laser light by the BD 803, based on the respective adjustment amounts according to the initial adjustment values, and an image is formed.

Figure 7E:
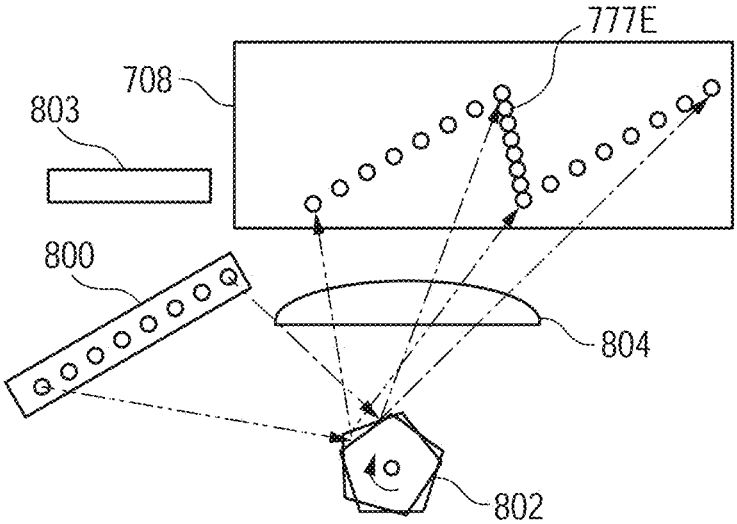
FIG. 7E is a diagram illustrating exposure spots on the photosensitive drum.

However, when the LSU 707 is embedded in the image forming apparatus 701, the ideal conditions may be distorted. In this case, as illustrated in FIG. 7E, the exposure spot row due to the light emitting elements of the light emitter 800 is "inclined" from the sub-scanning direction. For instance, in the case where the positions of the LSU 707 and the photosensitive drum 708 are distant from the ideal conditions, the apparatus comes into such a state. This inclination is caused by difference of the incident angle of the final laser beam of the exposure spot row 777C onto the photosensitive drum 708 from the incident angle of the leading laser beam of the exposure spot row 777B onto the photosensitive drum 708. The deviation component between the exposure spots of the laser beams emitted from the light emitting element at the opposite ends in the light emitter 800 is the maximum. The exposure spots of the laser beams emitted from the intermediate six light emitting elements strongly tend to sequentially deviate in a substantially stepwise manner. Owing to such an example as a factor, the exposure spots on the photosensitive drum 708 deviate from ideal positions.

Figure 8:
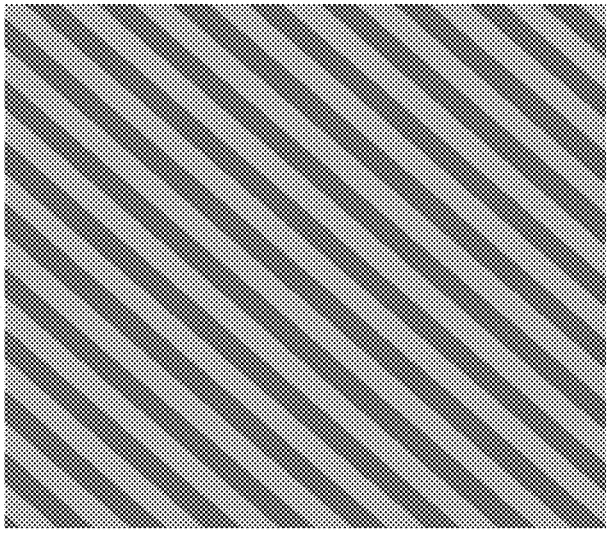
FIG. 8 is a diagram exemplifying a half tone image of 50% light emission where density unevenness occurs.

The inclination of the exposure spot row becomes a cause of moire as illustrated in FIG. 8. FIG. 8 is a diagram exemplifying a half tone image (hereinafter, called "HT image") by 50% light emission where inclination of the exposure spot row from the sub-scanning direction causes density unevenness. For instance, this image measures 10 [mm] square; moire occurs with a period of 1 [mm] in a rising diagonal direction to top left at an angle of 45 degrees. In the case where the light emission timing is adjusted, such moire does not occur, the image has a uniform halftone density according to a HT image, and inclination does not occur. The HT image is an example of a test pattern of the present invention.

Figure 9:
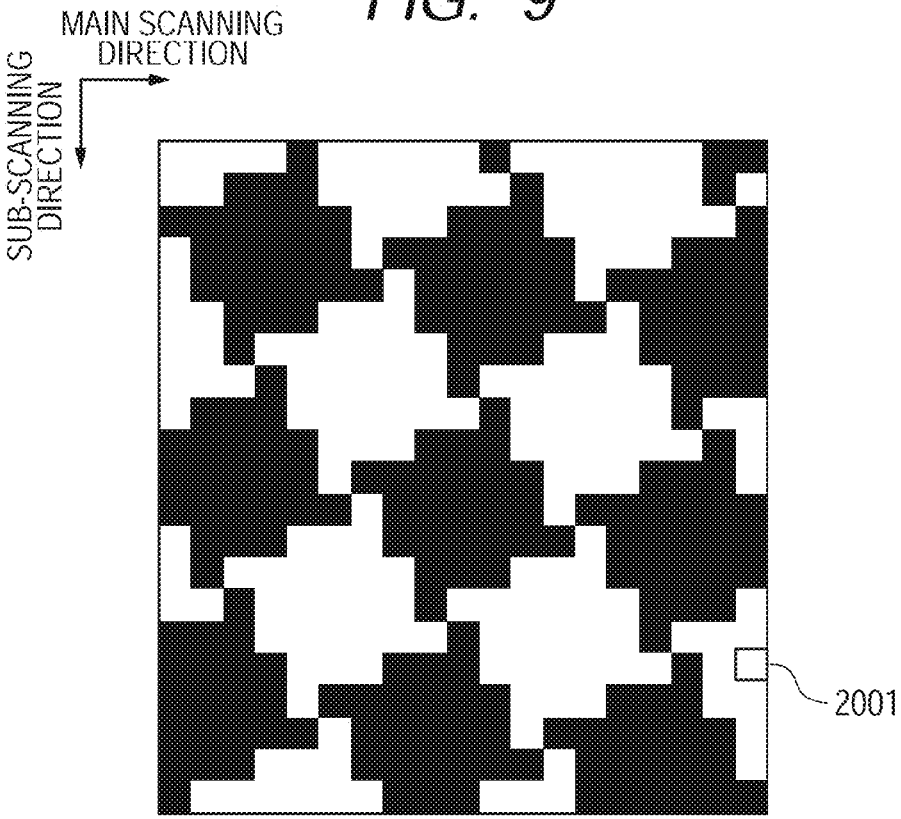
FIG. 9 is a diagram of an enlarged image of an HT image of 50% light emission where no moire occurs.

FIG. 9 is an enlarged image diagram of the HT image by 50% light emission where moire does not occur. The image measures 0.4 [mm] square. A rectangle 2001 in this diagram corresponds to one pixel at 1200 dpi.

Figure 10:
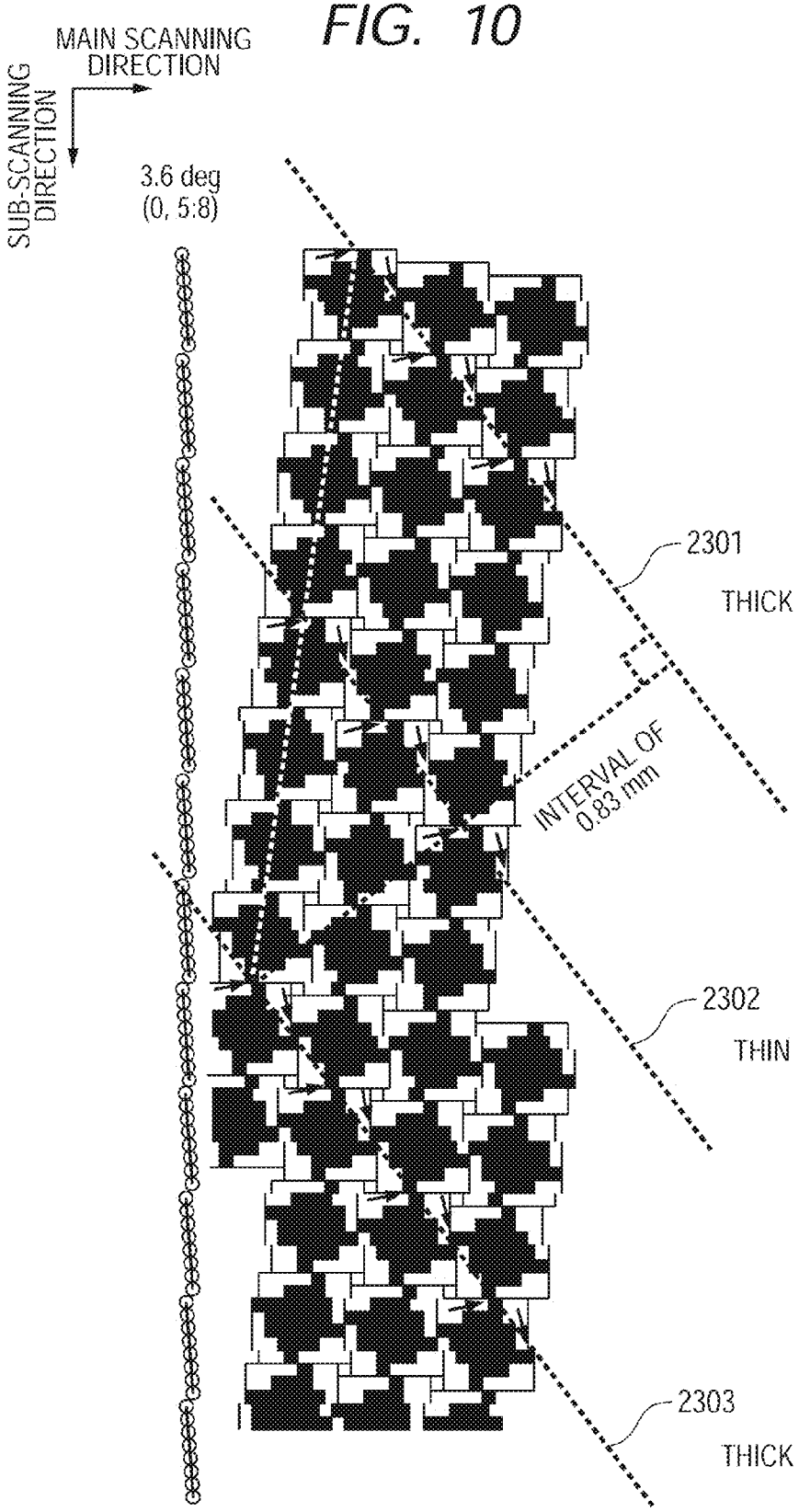
FIG. 10 is a diagram where a part of the HT image of FIG. 8 is enlarged.

FIG. 10 is an enlarged diagram of a part of the HT image of FIG. 8. Fine lines in the diagram are additional lines for clarifying a unit of a screen. To clarify the inclinations of the eight light emitting elements, the eight light emitting elements are classified into two groups of four elements. The four light emitting elements in each of the two groups deviate by 0.5 pixel. All the eight light emitting elements have an inclination as a ratio of 0.5 to 8 (equivalent to ca. 3.6 degrees). The periodicity of deviation due to the eight light emitting elements can be recognized by the step of the additional lines.

The moire as adverse effects of the inclination is caused by interference between the steps of eight laser periods and a minute connection part of the HT image. The minute connection part of the HT image is diagonally opposed parts of pixel arrays in the sub-scanning direction. On boundaries 2301 and 2303 in FIG. 10, the pixel arrays at the minute connection part deviate in a direction in which the arrays overlap with each other owing to boundary steps of the inclination of the light emitting elements. On a boundary 2302 in FIG. 10, the overlap at the minute connection part deviates in a direction in which the overlap is separated owing to the boundary steps. The boundaries 2301 and 2303 are well developed with toner owing to effects by the minute connection part. The boundary 2302 is not well developed owing to effects by the minute connection part. Accordingly, moire occurs. The moire occurs in a rising diagonal direction to top left at an angle of about 45 degrees with a period of about 0.83 [mm] according to the interval between the boundaries 2301 and 2303. From the structure of the minute connection part, it is inferred that the inclination monotonously increases up to a ratio of 1 to 8 (ca. 7.1 degrees) with one pixel deviation.

The part in which pixel arrays deviate from each other at the minute connection part in a direction in which the arrays overlap with each other is thus well developed with toner, because exposure distribution of each exposure spot is not a square. The exposure distribution of the exposure spot is a substantially circular trailing Gaussian distribution larger than 1200 dpi with a diameter of 1.5 to 2 pixels, for instance. In the case of increase in overlap of one pixel or less, the exposure spot tends to have a density higher than that for the number of pixels. In the case of increase in distance between exposure spots with one pixel or less, the spot tends to have a low density. Thus, regular moire occurs.

Operation of Image Forming Apparatus

Figure 11:
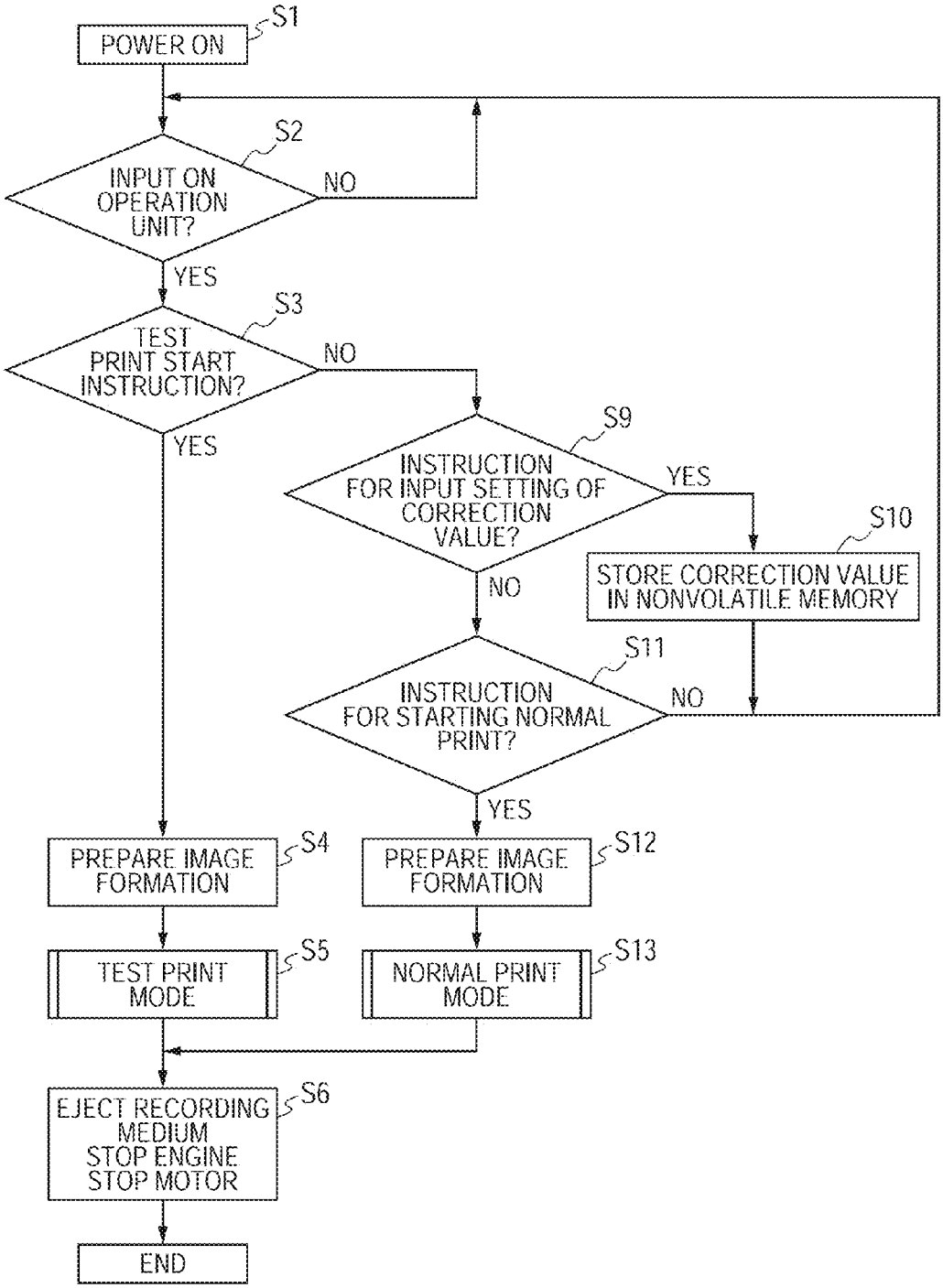
FIG. 11 is a flowchart illustrating processes executed by the image forming apparatus.

FIG. 11 is a flowchart illustrating processes executed by the image forming apparatus 701. The image forming apparatus 701 causes the controller, mainly the CPU 601, to execute processes for forming an image. The controller can execute a first sequence for test printing, a second sequence where correction values are input and set, and a third sequence that performs printing in a state where the light emission timing is adjusted. In the case of normal print, the processes of the third sequence are executed. After one of the LSU 707 and the photosensitive drum 708 is replaced by maintenance, the image forming apparatus 701 is required to execute the first and second sequences to verify and adjust inclination, thereby adjusting the light emission timing. After the adjustment, normal print is allowed according to the third sequence. In the case of slight image adjustment, combination of the first to third sequences can adjust the light emission timing.

After the main power source of the image forming apparatus 701 is turned on (S1), the CPU 601 of the controller waits for input on the operation unit 602 (S2). Upon input on the operation unit 602, the controller executes any one of the first to third sequences (S2: Y).

If the input on the operation unit 602 is a start instruction of test print according to an operation on the test print execution button 622 in FIGS. 6A to 6C, the CPU 601 executes the first sequence (S3: Y). The CPU 601 prepares for forming a test image when the first sequence starts (S4). After the preparation is completed, the CPU 601 performs test print in the test print mode (S5). The test print mode will be described later in detail. After the test print is finished, the CPU 601 ejects a recording medium on which after-mentioned test print image is formed, stops a drive engine and a motor, and finishes the processes (S6).

If the input on the operation unit 602 is an instruction for input setting of the correction value from the input screen 630 illustrated in FIGS. 6A to 6C, the CPU 601 executes the second sequence (S3: N, S9: Y). When the second sequence is started, the CPU 601 accepts input of the correction values from the operation unit 602. The correction values are input by operation on the input button columns 625, 626 and 627 in FIGS. 6A to 6C. The CPU 601 stores the input correction values in the nonvolatile memory 603 (S10). The collection value selected in the input button column 625 is written in the address "80" of the nonvolatile memory 603 illustrated in FIG. 5. The correction value selected in the input button column 626 is written in the address "81" of the nonvolatile memory 603 illustrated in FIG. 5. The correction value selected in the input button column 627 is written in the address "82" of the nonvolatile memory 603 illustrated in FIG. 5. At the initial state, all the values in the addresses "80" to "82" of the nonvolatile memory 603 are "0".

If the input on the operation unit 602 is an instruction for starting normal print, the CPU 601 executes the third sequence (S3: N, S9: N, S11: Y). When the third sequence is started, the CPU 601 prepares to form an image to be printed (S12). Here, each part necessary for an electrophotographic process is started to be driven. For instance, the polygon mirror 802 is started to be rotated, and light intensity stabilization control due to light emission from each light emitting element of the light emitter 800 is started. After the preparation is completed, the CPU 601 performs normal printing in the normal print mode (S13). The normal print mode will be described later in detail. After the print is finished, the CPU 601 ejects a recording medium on which an image based on an image data is formed, stops the drive engine and the motor, and finishes the processes (S6).

Normal Print Mode

Figure 12:
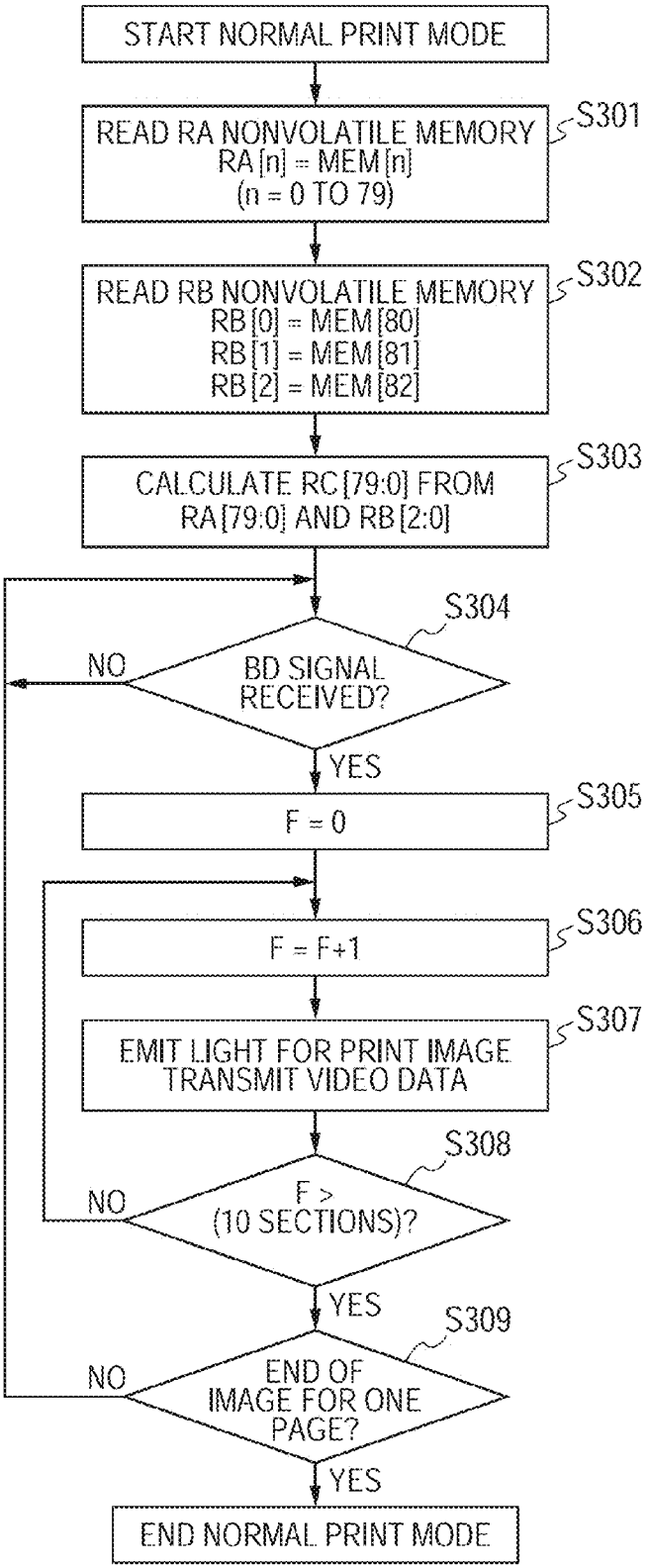
FIG. 12 is a flowchart illustrating processing procedures of a third sequence.

FIG. 12 is a flowchart illustrating detailed processing procedures of the normal print mode in the third sequence. In the normal print mode, the CPU 601 reads the initial adjustment values from the addresses "0" to "79" of the nonvolatile memory 603, and stores the values in "0 to 79" of the array RA 606 of the internal register (S301). After the initial adjustment values are stored in the array RA 606, the CPU 601 reads the correction values from the addresses "80" to "82" of the nonvolatile memory 603, and stores the values in the addresses "0" to "2" of the array RB 607 of the internal register (S302).

The CPU 601 sequentially calculates the values (adjustment values) in "0" to "79" of the array RC 608 of the internal register from the values stored in the array RA 606 and the array RB 607 of the internal register (S303). Based on the adjustment value, the light emission timing of each light emitting element of the light emitter 800 is adjusted. The correction values for three points in the array RB 607 are used as they are for deriving the adjustment values for "2", "6" and "9" (array RC[1], array RC[5], array RC[8]) among the image sections 810 in FIG. 4. The adjustment amount acquired by linear interpolation operation centered on "6" among the image sections 810 whose image height is "0" is generated superposed on the array RA 606. The adjustment values in the array RC 608 are calculated by the following equations.

In ($0 \le n \le 5$), $$RC[n]=RA[n]+(RB[1]-RB[0])/4\times(n-1)+RB[0] \quad \text{(Expression 1)}$$

In ($5 \le n \le 9$), $$RC[n]=RA[n]+(RB[2]-RB[1])/4\times(n-5)+RB[1] \quad \text{(Expression 2)}$$

n indicates the image section in FIG. 4.

FIG. 13 is a diagram exemplifying the adjustment values in the array RC 608. "2", "6" and "9" of the image sections 810 are calculated faithfully to the adjustment values. The other interpolated parts are approximated. As illustrated in FIG. 13, the adjustment values stored in the array RC 608 are completely identical to those in the array RA 606 if the values of the array RB 607 are (0, 0, 0). If the values of the array RB 607 are (−1, +1, +1), the values are calculated by the above equations.

After calculation of the adjustment values in the array RC 608, upon reception of the synchronization signal output when the BD 803 detects the laser light, the CPU 601 initializes the register F 609 of the internal register to "0" (S304: Y, S305). On each lapse of time of scanning one of "1" to "10" among the image sections 810 in FIG. 4, the CPU 601 increments the value of the register F 609. Furthermore, according to the image data and the adjustment values in the array RC 608, the eight light emitting elements of the light emitter 800 are adjusted to form an electrostatic latent image on the photosensitive drum 708 (S306 and S307). Up to "10" among the image sections 810, i.e., until the value of the register F 609 reaches "10", the processes in S306 and S307 are performed, thus scanning the "1" to "10" among the image sections 810 (S308). These processes in S304 to S308 are executed up to the final line of the image, and the normal print mode is finished (S309: Y).

As described above, if the input button columns 625, 626 and 627 are "0", the light emission timings are adjusted based on the initial adjustment values for the LSU 707 to form an image. If correction values other than "0" are input from the input button columns 625, 626 and 627, the light emission timings are adjusted based on the adjustment values in consideration of the input correction values to form an image.

Test Print Mode

Figure 14:
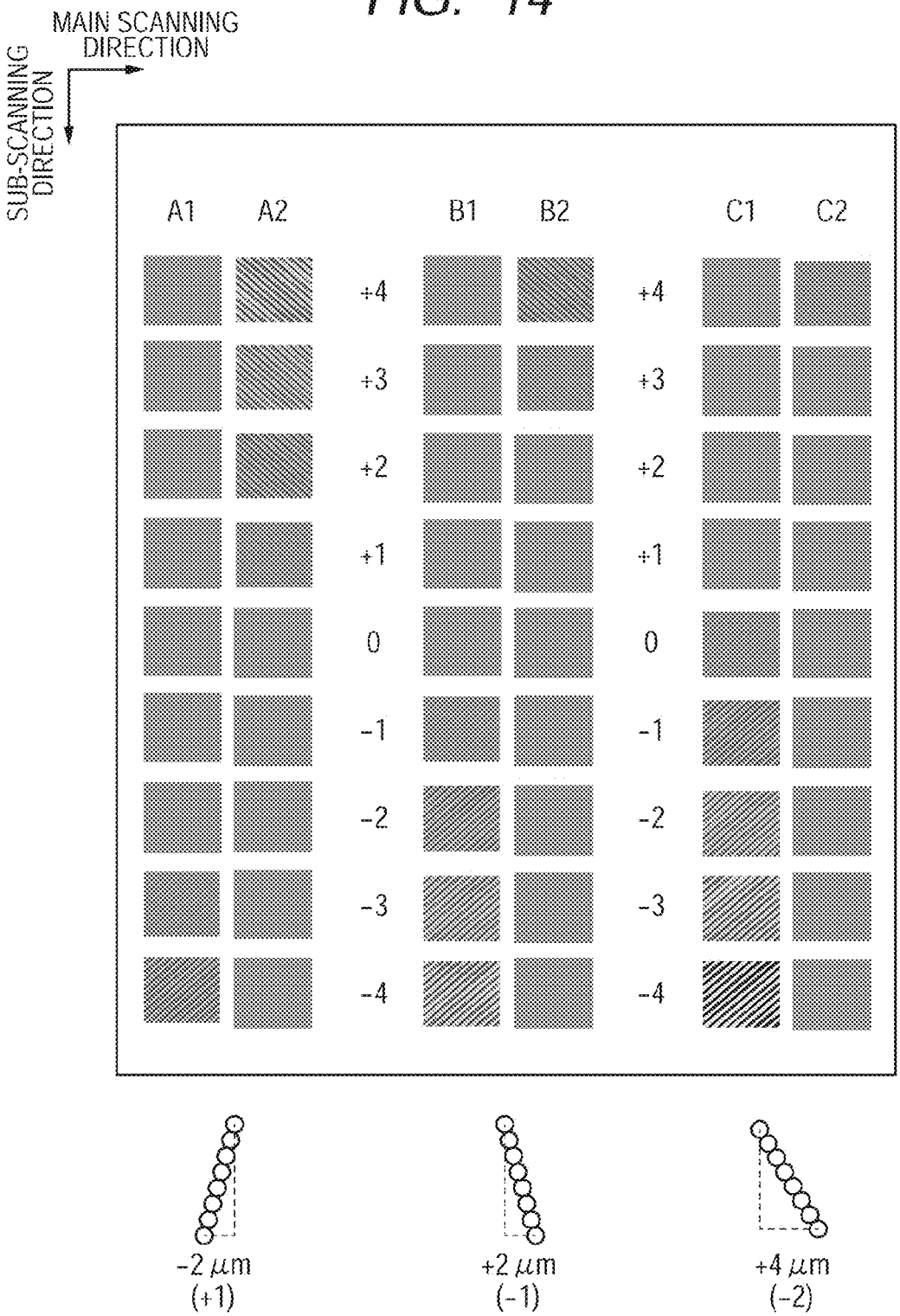
FIG. 14 is a diagram exemplifying a test print image.

FIG. 14 is a diagram exemplifying test print images output in a test mode. The test print images include groups of pattern images, which are a group of pattern images in an A1 column, a group of pattern images in an A2 column, a pattern group of images in a B1 column, a group of pattern images in a B2 column, a group of pattern images in a C1 column and a group of pattern images in a C2 column, and numerals "−4" to "+4" corresponding to the correction values as illustrated in FIG. 14. Each groups of pattern images includes a plurality of HT images (at least two pattern images). The A columns (A1 column and A2 column) correspond to "2" among the image sections 810. The B columns (B1 column and B2 column) correspond to "6" among the image sections 810. The C columns (C1 column and C2 column) correspond to "9" among the image sections 810. Presence and absence of moire in each region of the image in the main scanning direction can be detected using the group of pattern images on the A column, the group of pattern images on the B column and the group of pattern images on the C column, which are formed on the different positions in the main scanning direction. The HT images are provided for the respective numerals of the correction values "−4" to "+4". In each of the A column, the B column and the C column, a pair of two HT images is displayed for one numeral. In this example, 54 HT images are thus displayed. For instance, the HT image is a 10 [mm] square at 1200 dpi. In the case of the color image forming apparatus, test print images are formed for the respective colors.

Although not included in the test print image, for illustration purpose, FIG. 14 exemplifies an inclination state of an exposure point row. In the A column, the inclination deviation of the exposure point row is −2 [μm]. In the B column, the inclination deviation of the exposure point row is +2 [μm]. In the C column, the inclination deviation of the exposure point row is +4 [μm].

Each HT image is an image analogous to that in FIG. 8. Interference with a periodic step occurring at the boundary of the sub-scanning lines due to the inclination of the exposure spot row causes moire of about 1 [mm] with high sensitivity and visibility.

Figure 15:
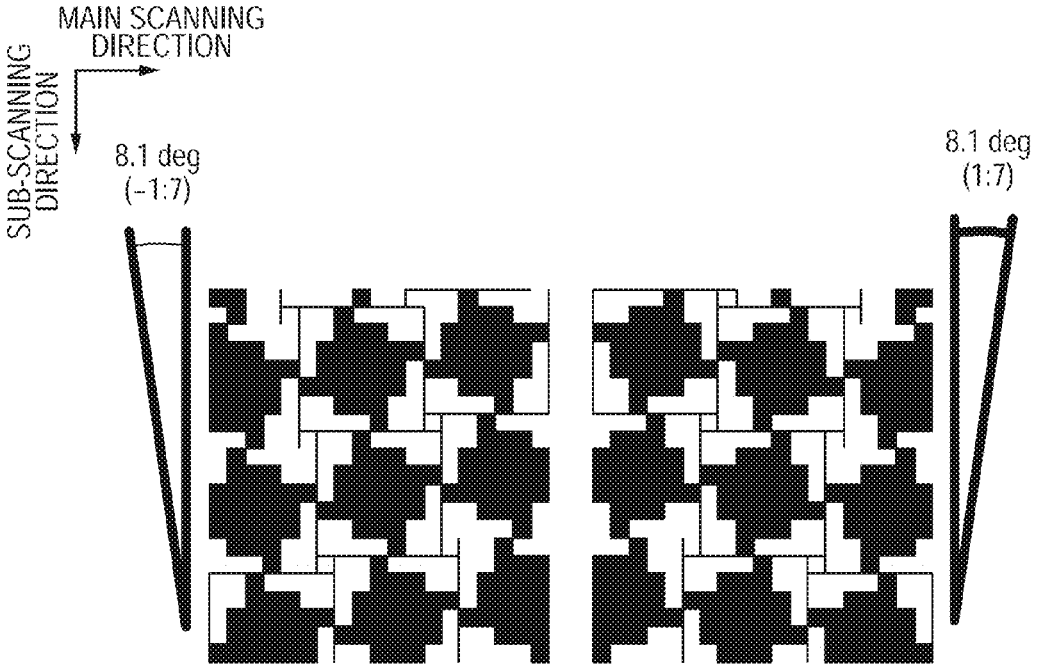
FIG. 15 is an enlarged diagram exemplifying the HT image.

FIG. 15 is an enlarged diagram exemplifying the HT images displayed as a pair of two images. The HT image with 8.1 deg. (−1:7) is a screen image (the HT image with a first screen angle) inclined by 8.1 degrees from the rotational direction of the photosensitive drum. Meanwhile, the HT image with 8.1 deg. (1:7) is a screen image (the HT image with a second screen angle) inclined at 8.1 degrees in the direction opposite to that of the HT image inclined by 8.1 degrees (−1:7) from the rotational direction of the photosensitive drum. That is, the HT image inclined at 8.1 degrees (−1:7) and the HT image inclined at 8.1 degrees (1:7) are symmetric screen images with respect to the rotational direction of the photosensitive drum (sub-scanning direction). For instance, 8.1 degrees (−1:7) indicates a part of a HT image in the A1 column, and 8.1 degrees (1:7) indicates a part of a HT image in the A2 column. As with FIG. 9, the HT image is made of screen halftone inclined by 8.1 degrees. In FIG. 15, the left HT image has left inclination according to the inclination of the exposure spot row, the right HT image has right inclination according to the inclination of the exposure spot row. Accordingly, in the HT images in the A1, B1 and C1 columns in FIG. 14, moire with left inclination occurs. Meanwhile, in the HT images in the A2, B2 and C2 columns, moire with right inclination occurs.

The HT images in each column in FIG. 14 are formed by the LSU 707 whose relative light emission timings of the respective light emitting elements have been adjusted according to the correction values corresponding to the laterally added numerals. The difference between the light emission timings changes occurrence of moire due to inclination. More specifically, in some cases, the density of moire is changed and no moire is observed. A user compares the HT images formed on the recording medium, and determines adjustment conditions for the inclination. Each numeral represents that the exposure spot row is inclined from the sub-scanning direction stepwise from "0" by a step of 2 [μm]. For instance, at the numeral of "+4", the relative light emission timing of each light emitting element is adjusted for an inclination of 8 [μm] to the right. At the numeral of "−4", the relative light emission timing of each light emitting element is adjusted for an inclination of 8 [μm] to the left.

The user compares the HT images in each column, and selects the HT image with the least visible moire from among the test print images in FIG. 14. According to the numeral laterally adjacent to the selected HT image, the correction value is determined. The numeral is input on the input button columns 625, 626 and 627 on the input screen 630 in FIGS. 6A to 6C, thereby allowing correction values to be input. For instance, in the case of the A column, in A1, the HT image corresponding to "−4" has most right-inclined moire strongly occurs. The moire decreases with increase in numeral. In A2, the HT image corresponding to "+4" has most left-inclined moire. The moire decreases with numeral. Since the difference between parts with little moire from "−2" to "0" is significantly small, determination is difficult. However, the moire is observed to be equivalent in intensity at "+2" and "±4". Accordingly, the user selects the well-balanced numeral "−1" at the center that has the smallest moire in A1 and A2 as the correction value. Likewise, "+1" is selected in the B column as the correction value, and the "+2" is selected in the C column as the correction value.

According to the second sequence in FIG. 11, the user inputs three correction values; that is, the user selects and inputs "−1" in the input button column 625 on the input screen 630, selects and inputs "+1" in the input button column 626, and selects and inputs "+2" in the input button column 627, as illustrated in FIG. 6B. The input values are stored in the addresses "80" to "82" of the nonvolatile memory 603. In the normal print mode, the values in the addresses "80" to "82" of the nonvolatile memory 603 are written into the array RB 607 of the internal register in the CPU 601, and used to adjust the light emission timing of the LSU 707. Thus, the light emission timing of each light emitting element is adjusted, and an image with an improved image quality is acquired.

If no moire is detected as in C2 of the C column, the user selects "IV" (Invisible) in the input button column 627 as illustrated in FIG. 6C. In this case, "0" is stored in all the addresses "80" to "82" of the nonvolatile memory 603. If the HT image with the highest moire cannot be correctly recognized, there is a possibility that normal pattern detection or adjustment is not performed. Factors preventing the HT image with strong moire from being correctly recognized may be positional deviation and deformation of an optical system device due to an unexpected impact, and contamination and increase in unevenness of the photosensitive drum 708 and the LSU 707. Accordingly, if no moire is detected in a result of reading the test print image, all the addresses "80" to "82" of the nonvolatile memory 603 are set to "0" so as not to increase the inclination due to inappropriate adjustment.

According to this adjustment of the test print image through use of moire, moire becomes hard to occur in image formation, thereby improving image quality. According to fine adjustment using a pattern easily causing moire, the inclination deviation of the exposure spots is improved and moire becomes hard to occur, thereby improving image quality.

Figure 16:
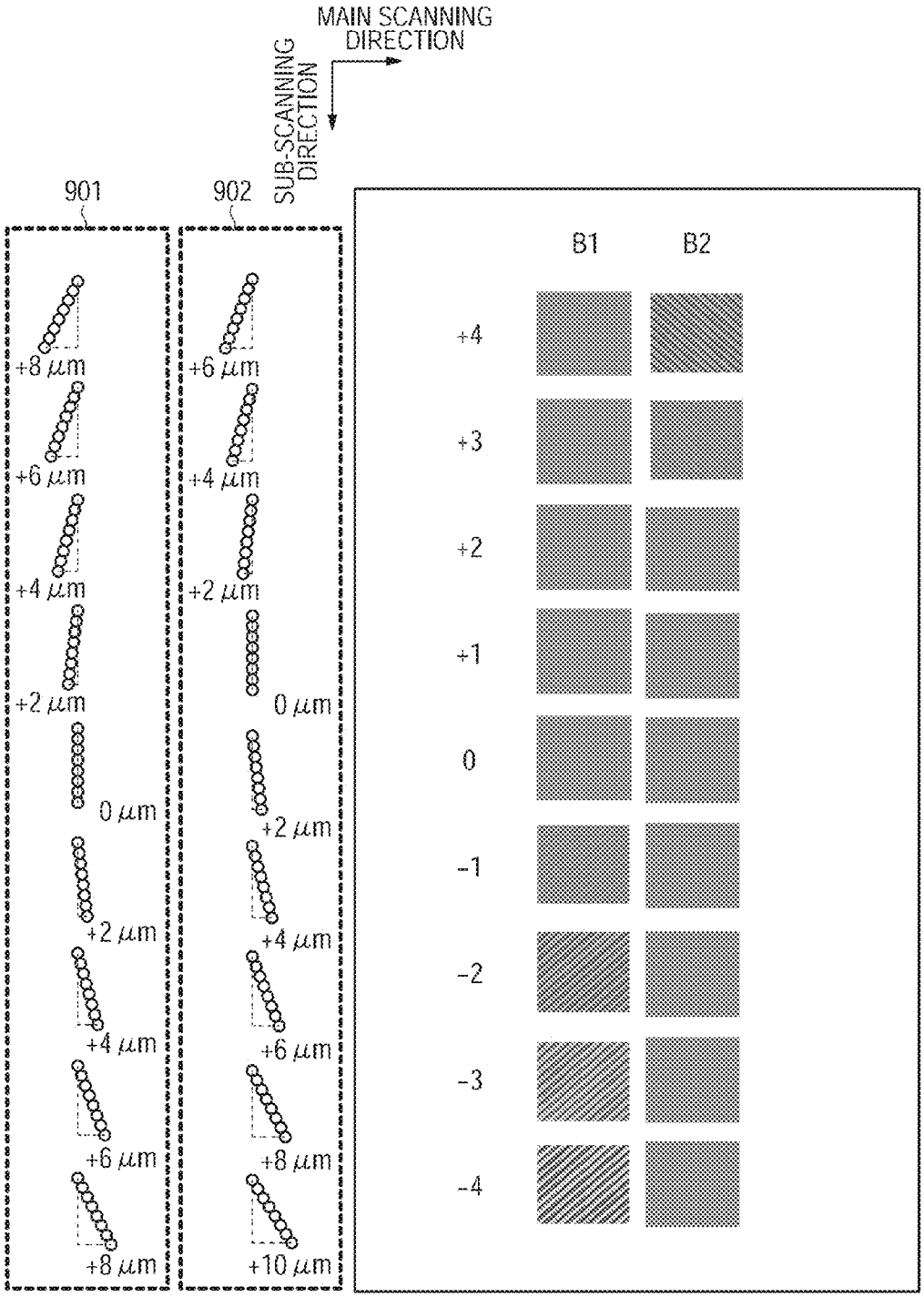
FIG. 16 is a diagram exemplifying the HT images in the B column among the test print images, an arrangement of an exposure spot row on the photosensitive drum in an ideal state, and an arrangement of an actual exposure spot row.

FIG. 16 is a diagram exemplifying the HT images in the B column among the test print images, an arrangement 901 of an exposure spot row on the photosensitive drum 708 in an ideal state, and an arrangement 902 of an actual exposure spot row. According to the arrangement 901, in the case where the numeral corresponding to the correction value is "0", the exposure spot row is aligned with the sub-scanning direction. In this case, the light emission timings of the light emitting elements of the light emitter 800 are adjusted according to the initial adjustment values. As the correction values are added, the exposure spot row is inclined stepwise from the sub-scanning direction by a step of 2 [μm] accordingly. In this case, the light emission timings of the light emitting elements of the light emitter 800 are adjusted according to the adjustment values in which the correction values are added to the initial adjustment values. The arrangement 902 is in a state where a left inclination deviation of 0.7 degree (ca. [μm]) occurs in the exposure spot row from the arrangement 901. If the numeral corresponding to the correction value is "0", a left inclination deviation of 0.7 degrees (ca. 2 [μm]) occurs as with the pixel row 777*e* in FIG. 7E. Correction values are input so as to adjust the deviation. In the arrangement 902, if the numeral corresponding to the correction value is "+1", the exposure spot row is aligned with the sub-scanning direction. That is, in the array 902, if the light emission timing is adjusted based on the correction value corresponding to "+1", the exposure spot becomes an ideal arrangement.

Figure 17:
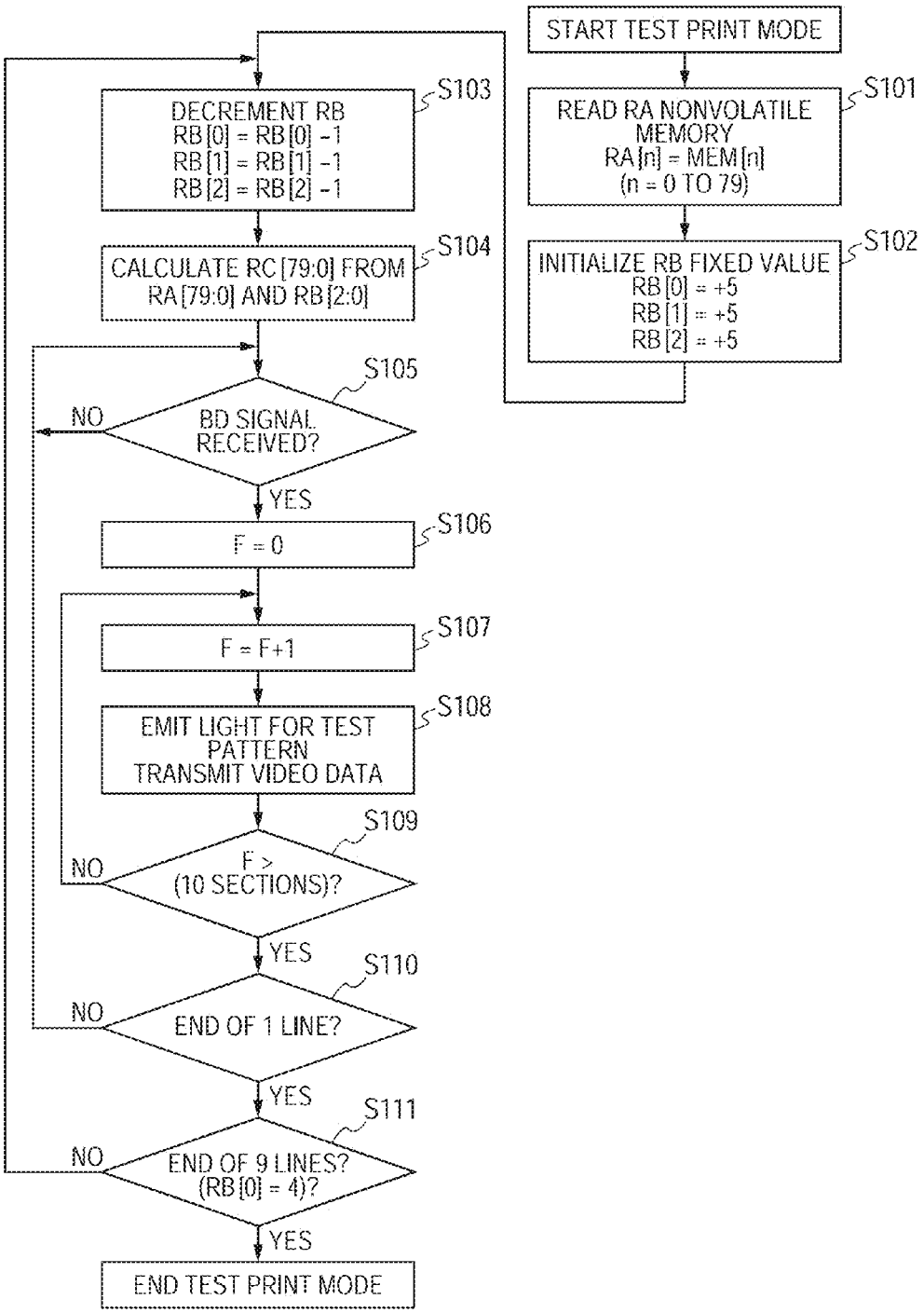
FIG. 17 is a flowchart illustrating processing procedures of a first sequence.

FIG. 17 is a flowchart illustrating detailed processing procedures in the test print mode in the first sequence. In the test print mode, the test print screen as illustrated in FIG. 14 is formed.

In the test print mode, as with in the normal print mode, the CPU 601 reads the initial adjustment values from the nonvolatile memory 603, and stores the values in the array RA 606 of the internal register (S101). After the initial adjustment values have been stored in the array RA 606, the CPU 601 initializes the entire array RB 607 to "+5" (S102). The array RB 607 functions as a register for forming nine HT images for one column in the test print screen. The CPU 601 decrements each value in the array RB 607, and sequentially derives the values in the addresses "0" to "79" of the array RC 608, which are adjustment values for adjusting the light emission timings, based on the array RA 606 and the array RB 607 (S103, S104).

After deriving the adjustment values in the array RC 608, upon reception of the synchronization signal from the BD 803, the CPU 601 initializes the register F 609 of the internal register to "0" (S105: Y, S106).

The CPU 601 increments the values in the register F 609 on every lapse of time for scanning "1" to "10" in the image sections 810 in FIG. 4. Based on the test print screen in FIG. 14, the light emission timings of the eight light emitting elements of the light emitter 800 are adjusted according to the adjustment values in the array RC 608 to form an electrostatic latent image on the photosensitive drum 708 (S107, S108). Up to "10" of the image sections 810, i.e., until the value of the register F 609 reaches "10", the processes in S107 and S108 are executed, thereby scanning from "1" to "10" of the image sections 810 (S109). The processes in S105 to S109 are repeated until the HT images arranged at the numeral "+4" in FIG. 14 are formed to form a gap of 10 [mm] between the HT images (S110). This repetition forms the HT images in the case where the entire array RB 607 is "+4".

Subsequently, the CPU 601 repeats the processes in S103 to S110 until the entire array RB 607 reaches "−4" (S111). The above processes acquire the test print image illustrated in FIG. 14. After the image is formed, the recording medium on which the test print image is formed is ejected from the image forming apparatus 701, and the test print mode in the first sequence is completed. The user can determine the correction values based on the ejected recording medium, as described above.

Second Embodiment

In the first embodiment, the example of visually determining and adjusting the test print image has been described. In a second embodiment, an example of providing a sensor for determining the test print image in the image forming apparatus 701 and detecting the intensity and period of moire. The sensor is thus provided in the image forming apparatus 701, thereby reducing a load on adjustment operations during assembly and replacement of the LSU 707 and the photosensitive drum 708 in maintenance.

Figure 18:
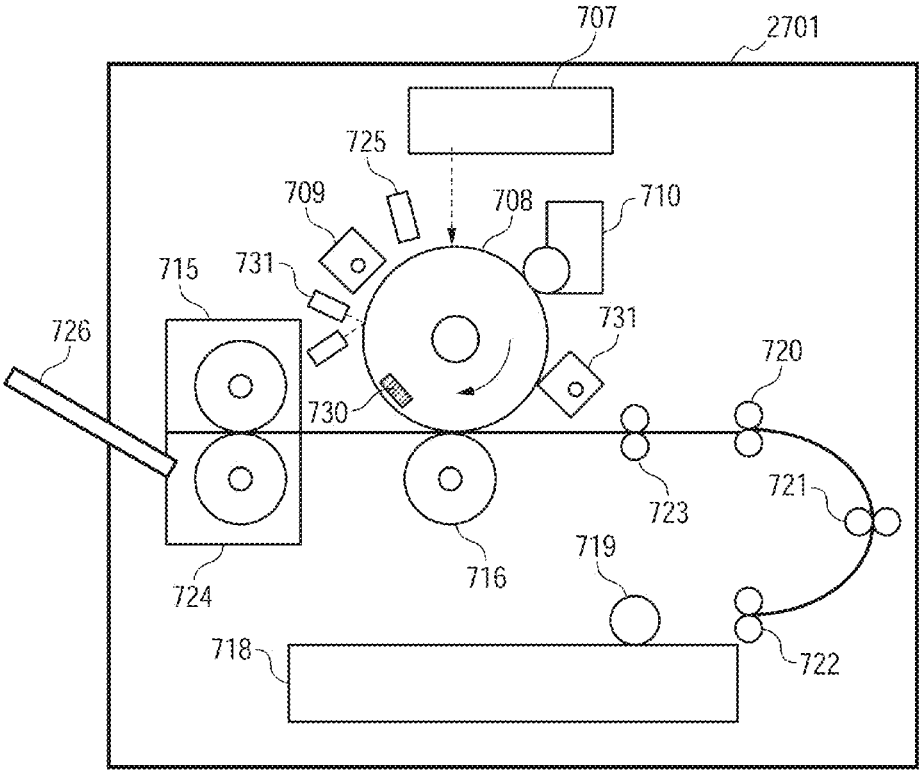
FIG. 18 is a diagram of an overall configuration of an image forming apparatus of a second embodiment.

FIG. 18 is a diagram of an overall configuration of an image forming apparatus 2701 of the second embodiment. This apparatus is different from the image forming apparatus 701 in the first embodiment in that a toner image sensor 732 for reading a toner image formed on the photosensitive drum 708 is provided in proximity to the photosensitive drum 708. The other configurations are the same. The description on the configurations identical to those of the image forming apparatus 701 is omitted.

In the second embodiment, the toner image of the test print image formed on the photosensitive drum 708 as with the first embodiment remains on the photosensitive drum 708 without being transferred onto the recording medium at the transfer unit 716 owing to change in high secondary transfer voltage. The toner image sensor 732 reads the remaining toner image 730. The toner image 730 is read by the toner image sensor 732, and subsequently cleaned and collected by the drum cleaner 709 to disappear.

Figure 19:
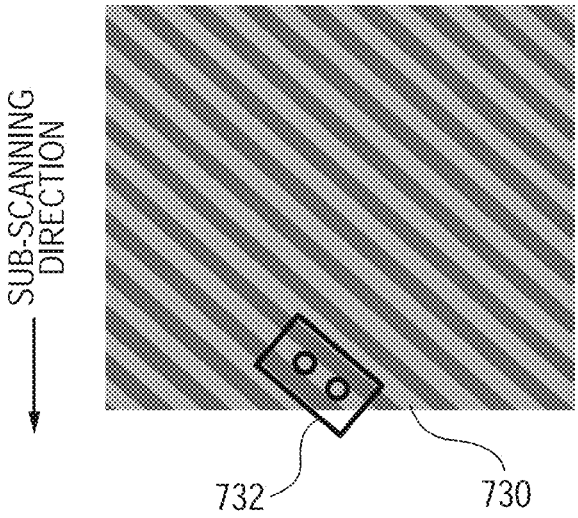
FIG. 19 is a diagram illustrating positional relationship between a toner image sensor and a toner image of a test print image.

FIG. 19 is a diagram illustrating a positional relationship between the toner image sensor 732 and the toner image 730 of the test print image. In the second embodiment, the toner image sensor 732 is a projection and reflection type sensor combining two photodiodes equivalent in performance to one LED. The reflected light of light emitted from the LED is received and detected by a photodiode. Two circles in the toner image sensor 732 in FIG. 19 represent two detection spots on the photosensitive drum 708. The two detection spots are disposed left-inclined at 45 degrees from the sub-scanning direction, and have a diameter of about 0.3 [mm]. The detection signal of the toner image read by the toner image sensor 732 is AD-converted and then detected and determined by the CPU 601.

The toner image 730 is conveyed in the sub-scanning direction by rotation of the photosensitive drum 708 and passes through a detection plane of the toner image sensor 732. When the image passes through the detection plane, the toner image sensor 732 detects variation in density of moire of the toner image 730 as an oscillating waveform. The detected oscillating waveform has a shape similar to a sinusoidal wave because of dependence on the sensitivity of the toner image sensor 732, the shapes of the detection spots, and the moire intensity. The moire intensity can be detected as the amplitude of a sinusoidal wave at both the detection spots, because the gap between moire is sufficiently wider than the gap between the detection spots. The angle of moire can be detected as a difference between the signals of the respective two detection spots. In the case where the attachment angle of the toner image sensor 732 matches with the angle of moire, the amplitude of the difference is significantly small.

As described above, detection of the amplitude and difference of the signals acquired from the respective two detection spots allows the CPU 601 to detect the intensity and angle of moire. Accordingly, visual detection and adjustment in the first embodiment are automatically controlled by the internal processes in the CPU 601 without intervention of the operation unit. Even in the case of detecting a slight inclination of 2 [μm] of the multi-laser, the toner image sensor 732 does not require a capability of detecting an absolute position of 2 [μm]. Instead, the sensor is only required to determine variation in density in a wide spot, such as of 0.3 [mm]. Accordingly, the depth of focus of the lens of the toner image sensor 732 may be relatively small. An inexpensive sensor configuration can meet the requirements.

Another Embodiment

FIG. 14 illustrates the optimal example of the test print image including a line-symmetric combination of 54 HT images with respect to an inclination detection reference direction. However, a combination of one inclination pattern and the adjustment values of light emission timings can also meet the requirements for implementation. Instead, any limited patterns may be selected from the 54 HT images. Interference occurs provided that determination of detecting the amount of inclination is the range and tendency of inclination. Accordingly, based on only two test patterns at the minimum, it can be determined whether to be within the desired range or not, according to comparison of the patterns.

Figure 20:
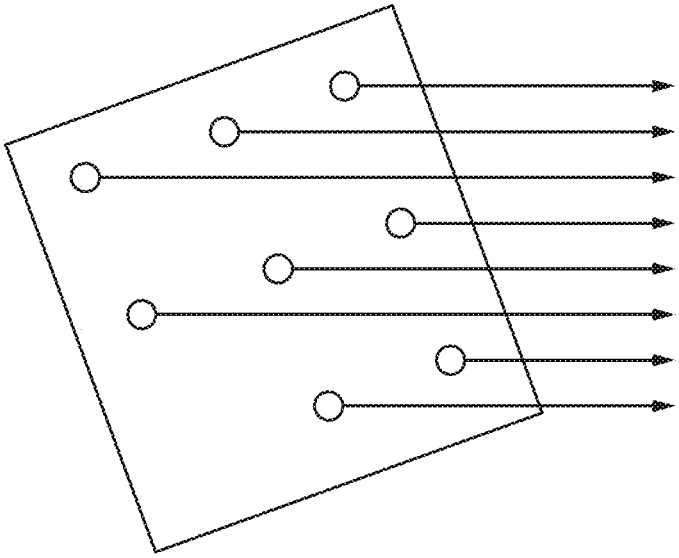
FIG. 20 is a diagram exemplifying arrangement of a laser array.
Figure 21:
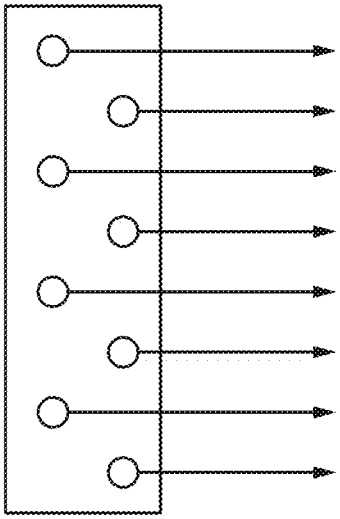
FIG. 21 is a diagram exemplifying arrangement of the laser array.

The light emitter 800 is the array of eight lasers in series. However, the mode of the laser array is not limited thereto. Even in the case where the resolutions and the number of lasers are different, if the moire period can be configured to have a long period suitable to the toner image sensor 732 and visual inspection, the configuration is applicable to many modes with at least two beams. The present invention is also applicable to the inclination deviation of a beam spot. Even in the cases where the laser array is one of a two-dimensional array as illustrated in FIG. 20 and a staggered array as illustrated in FIG. 21, the configuration is also applicable to adjustment of inclination deviation on a component of one-dimensional array in series of the entire array. The polygon mirror 802 may be any of various scanner configurations including a deflection mirror, such as a galvano mirror, common to multi-lasers.

50% HT with 7×7+1 dots screen matrix is used as the HT images of the test print image. To easily acquire regularity in moire intensity due to pixel positional deviation, it is desired that processes be executed within a range of inclination of 0.5 to 1 pixel or less with respect to the number of arranged light emitting elements. For instance, in the cases of series arrays of 64, 32, 8 and 4 light emitting elements correspond to 64:1, 32:1, 8:1 and 4:1, respectively. These cases are suitable to adjustment of inclinations of 0.9, 1.8, 3.6 and 7.1 degrees and of inclination deviations of about half or less thereof. Furthermore, since the apparatus forms an image used for visual recognition, it is desired that the period of moire be configured about 0.3 to 5 [mm] with high visual sensitivity. The function of the CPU 601 can be achieved by one of DSP and ASIC. Various digital processing methods can achieve the present invention.

The toner image sensor 732 in the second embodiment may be an image sensor capable of detecting the angle of moire. Through use of such an image sensor, abnormality of reading and reproducing moire is detected. In some cases, an angular resolution of about several degrees is sufficient as the capability of detecting the angle of moire. Also in these cases, a relatively inexpensive sensor configuration can achieve control. For instance, the types of sensors may be of a compound sensor configuration detecting one of conveyed electrostatic latent image and toner image, which are two dimensional images. Instead, the configuration may be adopted that uses a line CCD sensor for reading a printed sheet.

According to the present invention, test images are formed at two or more screen angles, thereby allowing the test images to be compared. Thus, even after the LSU and the photosensitive drum are embedded, the inclination deviation can be adjusted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-101478, filed Apr. 26, 2012, which is hereby incorporated by reference herein in its entirety.

What is claimed is:

1. An image forming apparatus comprising:

an image forming unit; and a control unit configured to control the image forming unit;

wherein the image forming unit comprises:

a photosensitive member to be rotated;

a light source including at least three light emitting elements each configured to emit a light beam to expose the photosensitive member, wherein the light beams emitted from the three light emitting elements expose positions on the photosensitive member different from each other in a rotational direction thereof;

a deflection unit configured to deflect the light beams so that each deflected light beam scans the photosensitive member; and a signal generating unit configured to receive one of the light beams deflected by the deflection unit and to generate a reference signal as a reference for an emission timing of each of the light beams based on receipt of said one light beam, wherein the image forming unit develops, with toner, an electrostatic latent image formed on the photosensitive member scanned by the light beams, and forms an image on a recording medium by transferring a toner image from the photosensitive member onto the recording medium, wherein the control unit causes the light emitting elements to emit the light beams based on an image data, wherein the control unit controls the emission timing of each of the light emitting elements based on a delay amount set for each of the light emitting elements relative to a generation timing of the reference signal, wherein the control unit causes the image forming unit to form a first pattern image, a second pattern image, a third pattern image and a fourth pattern image by using all of the light emitting elements, wherein a position at which the first pattern and the second pattern are formed is different from a position at which the third pattern and the fourth pattern are formed with respect to a scanning direction of the light beams, and wherein the emission timing of the light beams emitted from the light emitting elements relative to the generation timing of the reference signal for forming the first pattern image and that for forming the second pattern image are different from each other, and the emission timing of the light beams emitted from the light emitting elements relative to the generation timing of the reference signal for forming the third pattern image and that for forming the fourth pattern image are different from each other.

2. The image forming apparatus according to claim 1, wherein the control unit causes the image forming unit to form a first group of pattern images, a second group of pattern images, a third group of pattern images and a fourth group of pattern images, the first group of pattern images including the first pattern image and the second pattern image, and the second group of pattern images including the first pattern image and the second pattern image which is different from both of the first pattern image and the second pattern image included in the first group of pattern images, the third group of pattern images including the third pattern image and the fourth pattern image, and the fourth group of pattern images including the third pattern image and the fourth pattern image which is different from both of the third pattern image and the fourth pattern image included in the third group of pattern images, wherein the image forming unit forms the first group of pattern images at a first screen angle, forms the second group of pattern images at a second screen angle, forms the third group of pattern images at the first screen angle, and forms the fourth group of pattern images at the second screen angle.

3. The image forming apparatus according to claim 2, wherein the first screen angle and the second screen angle are symmetric with respect to the rotational direction of the photosensitive member.

4. The image forming apparatus according to claim 2, wherein the image forming unit is constructed to form images at selectable ones of a number of different screen angles, and wherein the control unit selects a first screen angle for forming the first group of pattern images and the third group of pattern images and a second screen angle for forming the second group of pattern images and the fourth group of pattern images, from among the different screen angles.

5. The image forming apparatus according to claim 2, wherein moire occurs in at least one of the pattern images included in the first group of pattern images, moire occurs in at least one of the pattern images included in the second group of pattern images, moire occurs in at least one of the pattern images included in the third group of pattern images, and moire occurs in at least one of the pattern images included in the fourth group of pattern images.

6. The image forming apparatus according to claim 1, wherein the image forming unit forms the first pattern image and the second pattern image at respective positions different from each other in the rotational direction of the photosensitive member, and forms the third pattern image and the fourth pattern image at respective positions different from each other in the rotational direction of the photosensitive member.

7. The image forming apparatus according to claim 1, wherein moire occurs in at least one of pattern images included in a group of pattern images.

8. The image forming apparatus according to claim 1, wherein the light source includes a plurality of light emitting elements each configured to emit a light beam, and the light emitting elements are two-dimensionally arranged.

9. The image forming apparatus according to claim 1, wherein the light source includes a plurality of light emitting elements each configured to emit a light beam, the light emitting elements are arranged in one line at equal intervals such that with respect to a scanning direction in which the light beams emitted from the light emitting elements scan the photosensitive member, different positions in the scanning direction are exposed to the light beams.

10. The image forming apparatus according to claim 9, wherein the control unit changes the emission timings of light beams other than a downstream-most exposure light beam in the scanning direction uniformly for a prescribed time with reference to the downstream-most exposure light beam on each of groups of pattern images.

* * * * *